US006923696B2

(12) United States Patent
Okuyama

(10) Patent No.: US 6,923,696 B2
(45) Date of Patent: Aug. 2, 2005

(54) ENGINE STARTING SYSTEM FOR MULTIPLE ENGINES

(75) Inventor: Takashi Okuyama, Hamamatsu (JP)

(73) Assignee: Yamaha Marine Kabushiki Kaisha, Shizuoka (JP)

( * ) Notice: Subject to any disclaimer, the term of this patent is extended or adjusted under 35 U.S.C. 154(b) by 0 days.

(21) Appl. No.: 10/624,984

(22) Filed: Jul. 22, 2003

(65) Prior Publication Data

US 2004/0121666 A1 Jun. 24, 2004

(30) Foreign Application Priority Data

Jul. 22, 2002 (JP) ..... 2002-212901

(51) Int. Cl.[7] ..... B63H 21/21; F02N 17/00

(52) U.S. Cl. ..... 440/85; 440/1; 440/84; 123/179.1; 123/DIG. 8

(58) Field of Search ..... 440/1–4, 84–87; 123/179.1, 179.2, 179.24, 179.27, 179.28, 179.5, 179.7, DIG. 8, 179.3; 290/38 R; 318/445

(56) References Cited

U.S. PATENT DOCUMENTS

| | | | | |
|---|---|---|---|---|
| 4,435,961 A | | 3/1984 | Stewart | 60/719 |
| 4,497,057 A | | 1/1985 | Kato et al. | |
| 4,649,708 A | | 3/1987 | Fisher | 60/700 |
| 4,692,918 A | | 9/1987 | Elliott et al. | |
| 4,708,669 A | | 11/1987 | Kanno et al. | 440/1 |
| 4,734,065 A | | 3/1988 | Nakahama et al. | 440/1 |
| 4,796,206 A | | 1/1989 | Boscove et al. | |
| 4,817,466 A | | 4/1989 | Kawamura et al. | |
| 4,836,809 A | | 6/1989 | Pelligrino | 440/2 |
| 4,850,906 A | | 7/1989 | Kanno | 440/2 |
| 4,897,554 A | * | 1/1990 | Uehara et al. | 290/38 R |
| 4,938,721 A | | 7/1990 | Koike | 440/2 |
| 5,031,562 A | | 7/1991 | Nakase et al. | |
| 5,230,643 A | | 7/1993 | Kanno | |
| 5,245,324 A | | 9/1993 | Jonker et al. | |
| 5,325,082 A | | 6/1994 | Rodriguez | |
| 5,352,138 A | | 10/1994 | Kanno | |
| 5,447,132 A | * | 9/1995 | Shoda et al. | 123/357 |
| 5,782,659 A | | 7/1998 | Motose | 440/1 |
| 5,852,789 A | | 12/1998 | Trsar et al. | |

(Continued)

FOREIGN PATENT DOCUMENTS

| | | | | |
|---|---|---|---|---|
| EP | 0 962 871 A2 | | 12/1999 | |
| GB | 0808657 | * | 2/1959 | F02D/25/00 |

(Continued)

OTHER PUBLICATIONS

Co–pending U.S. Appl. No.: 10/619,095; filed Jul. 11, 2003, entitled "Multiple Node Network and Communication Method Within the Network," inventor Takashi Okuyama.

(Continued)

*Primary Examiner*—S. Joseph Morano
*Assistant Examiner*—Ajay Vasudeva
(74) *Attorney, Agent, or Firm*—Knobbe, Martens, Olson & Bear, LLP

(57) ABSTRACT

A watercraft has multiple engines each having a starting device. A common switch mechanism provides a control device with at least an initiation signal to activate the starting devices, such that all of the engines can be started concurrently in response to operator activation of a single switch. A sensing device separately senses the start state of each engine, preferably by sensing an engine speed of each engine. The control device deactivates the starting device separately and asynchronously from one another based on the sensed start states of the engines.

31 Claims, 10 Drawing Sheets

U.S. PATENT DOCUMENTS

| | | | | | |
|---|---|---|---|---|---|
| 5,899,411 | A | * | 5/1999 | Latos et al. | 244/53 A |
| 5,904,604 | A | | 5/1999 | Suzuki et al. | |
| 5,935,187 | A | | 8/1999 | Trsar et al. | |
| 6,055,468 | A | | 4/2000 | Kaman et al. | |
| 6,141,608 | A | | 10/2000 | Rother | |
| 6,216,083 | B1 | | 4/2001 | Ulyanov et al. | |
| 6,330,553 | B1 | | 12/2001 | Uchikawa et al. | |
| 6,431,930 | B1 | | 8/2002 | Holt | |
| 6,529,816 | B1 | | 3/2003 | Yamaguchi et al. | |
| 2001/0049579 | A1 | | 12/2001 | Fujino et al. | |

FOREIGN PATENT DOCUMENTS

| | | | | | |
|---|---|---|---|---|---|
| JP | 61180598 | A | * | 8/1986 | H02P/7/67 |
| JP | 10-011105 | | | 1/1998 | |
| JP | 10-184429 | | | 7/1998 | |
| JP | 10-184431 | | | 7/1998 | |
| JP | 11037601 | A | * | 2/1999 | F25B/27/00 |
| JP | 11117781 | A | * | 4/1999 | B63H/21/21 |
| JP | 11-343916 | | | 12/1999 | |
| JP | 2000-076300 | | | 3/2000 | |
| JP | 2000-108995 | | | 4/2000 | |
| JP | 2000-313398 | | | 11/2000 | |
| JP | 2001-119416 | | | 4/2001 | |

OTHER PUBLICATIONS

Co–pending U.S. Appl. No.: 10/624,204; filed Jul. 22, 2003, entitled "Control Circuits and Methods for Inhibiting Abrupt Engine Mode Transitions in a Watercraft," inventor Takashi Okuyama.

Amendment Dated Apr. 12, 2004, filed in Co–pending U.S. Appl. No.: 10/255,042; filed Sep. 25, 2002, entitled "Diagnostic System For Watercraft," inventors Isao Kanno and Hitoshi Motose, assigned to Sanshin Kogyo Kabushiki Kaisha.

Amendment Dated Aug. 11, 2004, filed in Co–pending U.S. Appl. No.: 10/280,262; filed Oct. 24, 2002, entitled "Watercraft Control Systems," inventors Isao Kanno and Takashi Okuyama, assigned to Sanshin Kogyo Kabushiki Kaisha.

Amendment Dated Dec. 23, 2003, filed in Co–pending U.S. Appl. No.: 10/281,390; filed Oct. 24, 2002, entitled "Small Watercraft And Outboard Motor," inventor Isao Kanno, assigned to Sanshin Kogyo Kabushiki Kaisha.

International Standard; ISO 11783–5; Tractor and machinery for agriculture and forestry—Serial control and communications data network; Part 5: Network management; First edition May 1, 2001.

Co–pending U.S. Appl. No.: 10/251,722; filed Sep. 20, 2002, entitled "Engine Control System for Watercraft," inventor Isao Kanno, assigned to Sanshin Kogyo Kabushiki Kaisha.

Co–pending U.S. Appl. No.: 10/247,919; filed Sep. 20, 2002, entitled "Inspection System For Watercraft," Inventors Takashi Okuyama and Isao Kanno, assigned to Sanshin Kogyo Kabushiki Kaisha.

Co–pending U.S. Appl. No.: 10/255,042; filed Sep. 25, 2002, entitled "Diagnostic System For Watercraft," inventors Isao Kanno and Hitoshi Motose, assigned to Sanshin Kogyo Kabushiki Kaisha.

Co–pending U.S. Appl. No.: 10/254,818; filed Sep. 25, 2002, entitled "Watercraft Management System," inventors Takashi Okuyama and Hitoshi Motose, assigned to Sanshin Kogyo Kabushiki Kaisha.

Co–pending U.S. Appl. No.: 10/280,262; filed Oct. 24, 2002, entitled "Watercraft Control Systems," inventors Isao Kanno and Takashi Okuyama, assigned to Sanshin Kogyo Kabushiki Kaisha.

Co–pending U.S. Appl. No.: 10/281,390; filed Oct. 24, 2002, entitled "Small Watercraft And Outboard Motor," inventor Isao Kanno, assigned to Sanshin Kogyo Kabushiki Kaisha.

NMEA 2000; Standard for Serial Data Networking of Marine Electronic Devices; Main Document; Version 1.000, Sep. 12, 2001; @NMEA 1999, 2000, 2001.

NMEA 2000; Standard for Serial Data Networking of Marine Electronic Devices; Appendix A; Version 1.000; Sep. 12, 2001; @NMEA 1999, 2000, 2001.

NMEA 2000; Standard for Serial Data Networking of Marine Electronic Devices; Appendix B; @NMEWA 1999, 2000, 2001.

NMEA 2000; Standard for Serial Data Networking of Marine Electronic Devices; Appendix C; Version 1.000, Sep. 12, 2001, @NMEA 1999, 2000, 2001.

NMEA 2000; Standard for Serial Data Networking of Marine Electronic Devices; Appendix D; Version 1.000, Sep. 12, 2001, @NMEA 1999, 2000, 2001.

NMEA 2000; Standard for Serial Data Networking of Marine Electronic Devices; Appendix E; ISO 11783–5 Network Management.

NMEA 2000; Standard for Serial Data Networking of Marine Electronic Devices; Appendix F; ISO 11783–3 DataLink Layer.

NMEA 2000; Standard for Serial Data Networking of Marine Electronic Devices; Appendix G; ISO 11898 Controller Area Network.

* cited by examiner

ENGINE STARTING SYSTEM FOR MULTIPLE ENGINES

PRIORITY INFORMATION

The present application is based on and claims priority under 35 U.S.C. §119 to Japanese Patent Application No. 2002-212901, filed on Jul. 22, 2002, the entire content of which is expressly incorporated by reference herein.

BACKGROUND OF THE INVENTION

1. Field of the Invention

The present invention generally relates to an engine starting system for multiple engines, and more particularly relates to an engine starting system for starting multiple engines by a common operating device.

2. Description of Related Art

Watercrafts can have multiple engines to obtain powerful propulsion force. For instance, some watercrafts are propelled by two or more outboard motors, each incorporating one engine. Each engine, not only for the outboard motors but also for other types of propulsion devices, can be provided with a starter motor coupled with a crankshaft of the engine to rotate the crankshaft for starting.

The starter motor is activated when an operator operates a switch mechanism. Normally, the operator operates each switch mechanism one by one if the watercraft has such multiple engines. In general, a certain period of time is necessary for the engine to start after the operator's activation of the switch mechanism. A relatively long time period thus is typically necessary to start the entire set of engines.

SUMMARY OF THE INVENTION

A need therefore exists for an engine starting system for multiple engines that can rapidly start the entire set of engines.

In a preferred embodiment of the invention, a control circuit is responsive to operator actuation of an auto-start switch by activating the respective starter motors of each of a plurality of engines, such as outboard motor engines of a watercraft. A sensor circuit senses the start state of each such engine, preferably by monitoring the engine speeds of the engines. When the sensor circuit senses that a particular engine has started, the control circuit preferably waits for a first preprogrammed time interval and then deactivates the corresponding starter motor. The starter motors are thus deactivated asynchronously relative to each other, and according to the start states of their respective engines. The first preprogrammed time interval is selected so as to substantially increase the likelihood that the engines will continue running following starter motor deactivation.

If an engine fails to start within a second preprogrammed time interval (which is ordinarily significantly longer than the first preprogrammed time interval), the control circuit deactivates the corresponding starter motor to conserve battery power. An error message may be communicated to the operator via a display unit or audio device in this event. An auto-cut switch may also be provided to allow the operator to override the second preprogrammed time interval, so that the operator can manually control the maximum length of time that the starter motors remain activated.

In accordance with one aspect of the present invention, a watercraft comprises a plurality of engines and a plurality of starting devices. Each starting device is coupled with a respective engine to power the engine for starting. A control device controls the starting devices. A common operating device provides the control device with at least an initiation signal to activate the starting devices. A sensing device separately senses a start completion state of each engine. The control device activates the each starting device when the operating device provides the initiation signal, and deactivates each starting device separately from the other starting devices when the sensing device senses the individual start completion state of the corresponding engine.

In accordance with another aspect of the present invention, a watercraft comprises a plurality of engines and a plurality of starting devices. Each starting device is coupled with a respective engine to power the associated engine for starting. A control device controls the starting devices. A common operating device provides the control device with an activation allowable time period or an initiation signal to initiate the activation allowable time period. A sensing device separately senses an individual start completion state of each engine. The control device activates the starting devices during the activation allowable time period. The control device deactivates each starting device separately from the others when the sensing device senses the individual start completion state of the respective engine.

In accordance with a further aspect of the present invention, an engine starting system is provided for multiple engines. Each engine has a starting device to power the engine for starting. The system comprises a control device that controls the starting devices. A common operating device provides the control device with at least an initiation signal to activate the starting devices. A sensing device separately senses an individual start completion state of each engine. The control device activates each starting device when the operating device provides the initiation signal, and deactivates each starting device in response to the sensing device sensing the individual start completion state of the corresponding engine.

In accordance with a further aspect of the present invention, an engine starting method is provided for multiple engines. Each engine has a starting device to power the engine for starting. The method comprises generating an activation initiating signal, initiating activating the starting devices based upon the activation initiating signal, separately sensing an individual start completion state of each engine, and deactivating each starting device in response to the start completion state of the corresponding engine being sensed.

BRIEF DESCRIPTION OF THE DRAWINGS

The foregoing and other features, aspects and advantages of the present invention are described in detail below with reference to the drawings of preferred embodiments which are intended to illustrate and not to limit the invention. The drawings comprise ten figures in which.

DETAILED DESCRIPTION OF THE PREFERRED EMBODIMENT OF THE INVENTION

Figure 1:
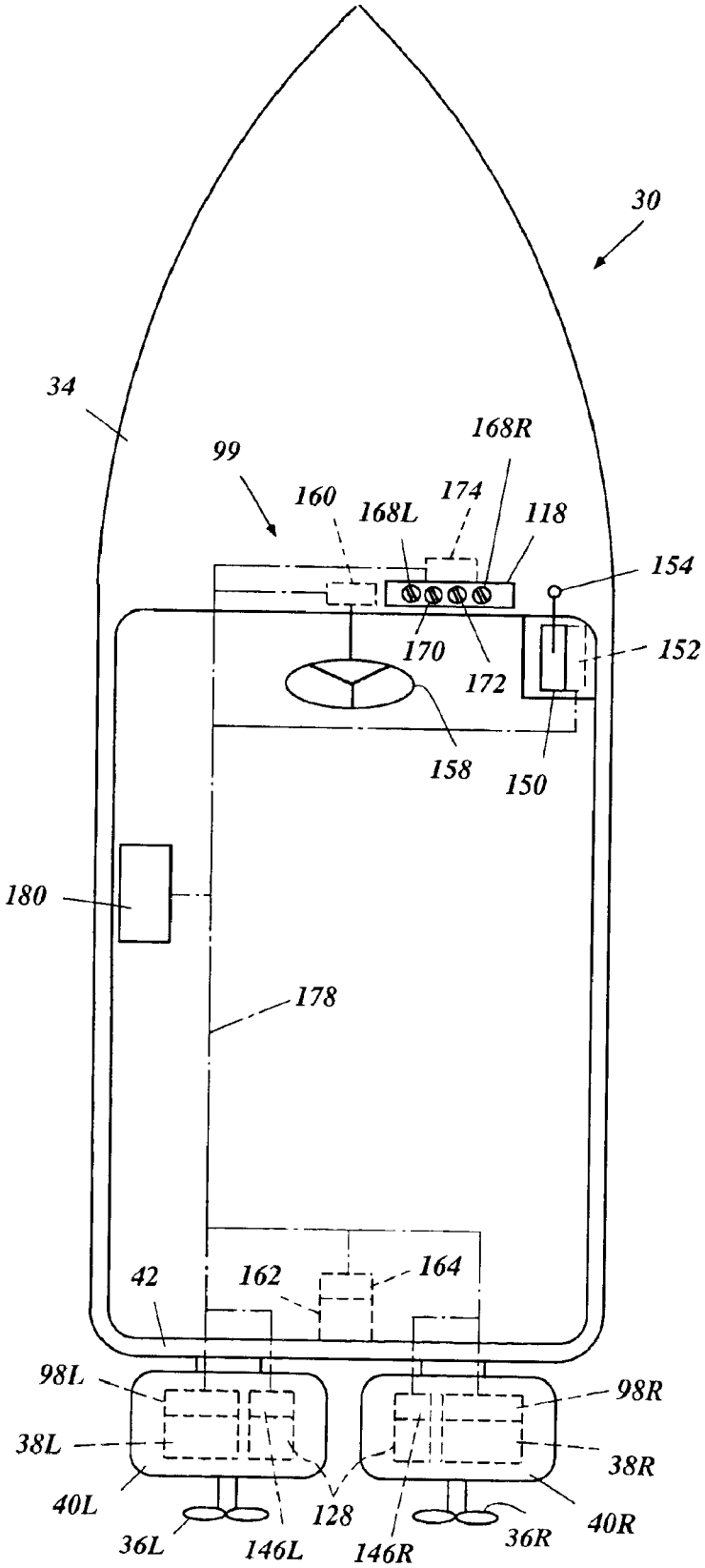
FIG. 1 illustrates a schematic representation of a top plan view of a watercraft that has an engine starting system configured in accordance with certain features, aspects and advantages of the present invention, the watercraft having a key switch unit as part of the engine starting system and a pair of outboard motors each incorporating one engine, wherein at least the switch unit and the engines are connected with each other through a network.
Figure 2:
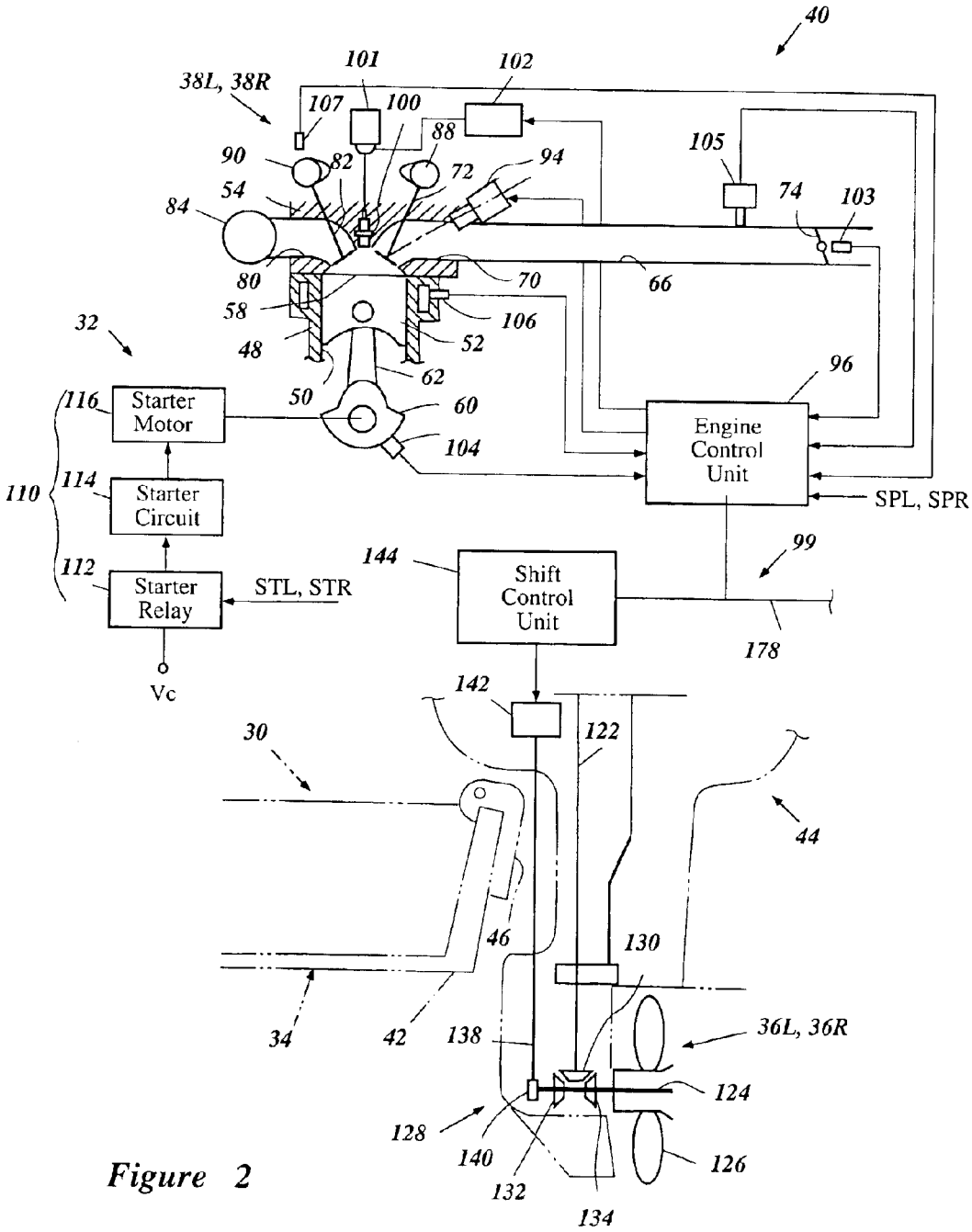
FIG. 2 illustrates a schematic representation of a side elevational view of the outboard motor of FIG. 1, wherein the engine, a starting device for the engine, a propulsion device, a changeover mechanism for the propulsion device, an engine control unit and a shift control unit are shown.
Figure 3:
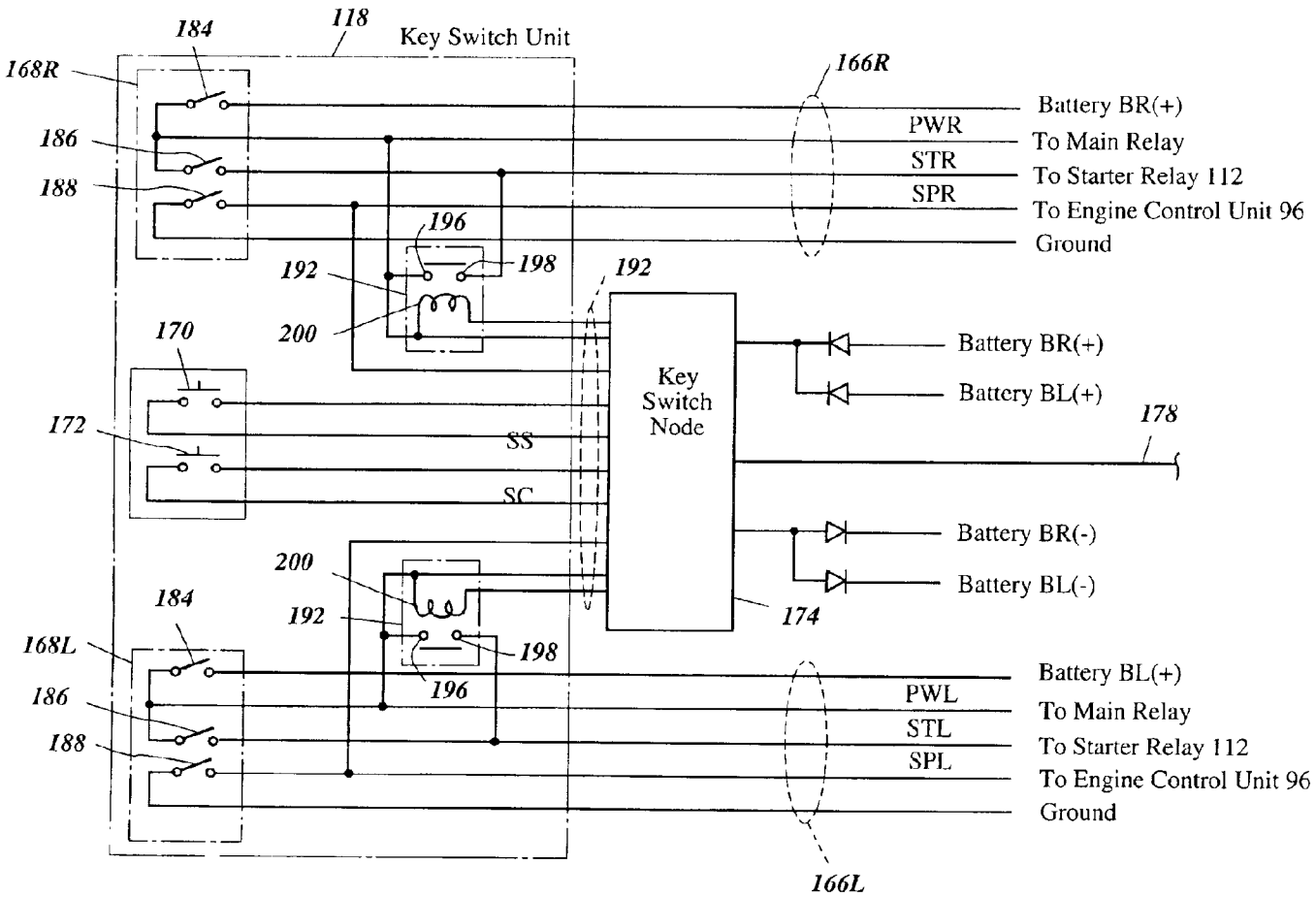
FIG. 3 illustrates a schematic representation of the key switch unit of FIG. 1 with wire harnesses connected to the starting devices and also with a key switch node, wherein the engine starting system is configured in accordance with a first preferred embodiment.

With reference to FIGS. 1–3, a watercraft 30 and an engine starting system 32 configured in accordance with certain features, aspects and advantages of the present invention are described below.

With reference to FIG. 1, the watercraft 30 has a hull 34. The watercraft 30 also has a pair of propulsion devices 36L, 36R that propel the hull 34 and a pair of internal combustion engines 38L, 38R that power the propulsion devices 36L, 36R, respectively. In the illustrated embodiment, a pair of outboard motors 40L, 40R is mounted on a transom 42 of the hull 34. Each outboard motor 40L, 40R incorporates a respective propulsion device 36L, 36R and a respective engine 38L, 38R. Other marine drives such as, for example, stern drives can replace the outboard motors 36L, 36R. The two outboard motors 40L and 40R may be substantially identical. Accordingly, the description below of a preferred motor and engine design (including the associated starting system) is applicable to both outboard motors, and to any others that may be provided.

With reference to FIG. 2, each outboard motor 40L, 40R comprises a housing unit 44 and a bracket assembly 46. The bracket assembly 46 supports the housing unit 44 on the transom 42 of the hull 34 so as to place the propulsion device 36L, 36R in a submerged position with the watercraft 30 resting on the surface of a body of water. The bracket assembly 46 preferably comprises a swivel bracket, a clamping bracket, a steering shaft and a tilt pin.

Each engine 38L, 38R is disposed atop the housing unit 44. The engines 38L, 38R preferably operate on a four-cycle combustion principle. Each engine 38L, 38R comprises a cylinder block 48 that defines four cylinder bores 50. A piston 52 can reciprocate in each cylinder bore 50. A cylinder head assembly 54 is affixed to the cylinder block 48 to close one end of the cylinder bores 50. The cylinder head assembly 54, in combination with the cylinder bores 50 and the pistons 52, define four combustion chambers 58. The cylinder head assembly 54 is disposed on the rear side of the engine 38L, 38R relative to the bracket assembly 46.

The other end of the cylinder block 48 is closed with a crankcase member that at least partially defines a crankcase chamber. A crankshaft 60 extends generally vertically through the crankcase chamber. The crankshaft 60 is connected to the pistons 52 by connecting rods 62 and is rotated by the reciprocal movement of the pistons 52.

Each engine 38L, 38R preferably is provided with an air intake system to introduce air to the combustion chambers 58. The air intake system preferably includes a plenum chamber, air intake passages 66 and intake ports 70 that are formed in the cylinder block 48. The air intake passages 66 and the intake ports 70 are associated with the respective combustion chambers 58. The intake ports 70 are defined in the cylinder head assembly 54 and are repeatedly opened and closed by intake valves 72. When the intake ports 70 are opened, the air intake passages 66 communicate with the associated combustion chambers 58.

Each engine 38L, 38R is covered with a protective cowling that has an air intake opening. Ambient air is drawn into a cavity around the engine 38L, 38R through the air intake opening. The air in the cavity is drawn into the respective air intake passages 66 through the plenum chamber. Because the intake passages 66 can communicate with the combustion chambers 58 when the intake valves 72 are opened, the air can enter the respective combustion chambers 58 at the open timing of the intake valves 72.

A throttle valve 74 preferably is disposed within each air intake passage 66 downstream of the plenum chamber to regulate an amount of air to each combustion chamber 58. The throttle valve 74 preferably is a butterfly type valve and moves between a fully closed position and a fully open position. The throttle valves 74 preferably have a common valve shaft journaled for pivotal movement. A certain amount of air is admitted to pass through the intake passage 66 in accordance with an angular position or an open degree of the throttle valve 74 when the valve shaft pivots.

A throttle valve actuator (not shown) preferably is coupled with the valve shaft to actuate the throttle valves 74. The throttle valve actuator preferably is a servomotor. Normally, the air amount or rate of airflow increases when the open degree of the throttle valves 74 increases. Also, the engine output or engine torque increases in accordance with the increase of the air amount. Unless the environmental circumstances change, an engine speed increases generally with the increase of the engine output. Additionally, an intake pressure downstream of each throttle valve 74, which is a negative pressure, also increases in accordance with the increase of the airflow rate.

Each engine 38L, 38R preferably is provided with an exhaust system to discharge burnt charges or exhaust gases to a location outside of the respective outboard motor 40L, 40R from the combustion chambers 58. Exhaust ports 80 are defined in the cylinder head assembly 54 and are repeatedly opened and closed by exhaust valves 82. An exhaust manifold 84 is connected to the exhaust ports 80 to collect the exhaust gases. The combustion chambers 58 communicate with the exhaust manifold 84 when the exhaust ports 80 are opened. The exhaust gases are discharged to a body of water that surrounds the outboard motor 40L, 40R through the exhaust manifold 84 and exhaust passages formed in the housing unit 44 when the engine 38L, 38R operates above idle. The exhaust gases also are directly discharged into the atmosphere through the exhaust manifold 84, an idle exhaust passage and an opening formed at the housing unit 44 when the engine 38L, 38R operates at idle.

An intake camshaft 88 and an exhaust camshaft 90 preferably are journaled for rotation and extend generally vertically in the cylinder head assembly 54. The intake camshaft 88 actuates the intake valves 72 while the exhaust camshaft 90 actuates the exhaust valves 82. The camshafts 88, 90 have cam lobes to push the respective valves 72, 82. Thus, the ports 70, 80 communicate with the combustion chambers 58 when the cam lobes push the valves 72, 82. Each camshaft 88, 90 and the crankshaft 60 preferably have a sprocket. A timing belt or chain is wound around the respective sprockets in this arrangement. Accordingly, the crankshaft 60 can drive the camshafts 88, 90 by the timing belt or chain.

Each illustrated engine 38L, 38R preferably has a fuel injection system. The fuel injection system employs four fuel injectors 94 allotted for each combustion chamber 58. The fuel is reserved in a fuel tank and is pressurized by multiple fuel pumps to the fuel injectors 94. Each fuel injector 94 is affixed to the cylinder head assembly 54 with a nozzle exposed into each intake port 70. The nozzle of each fuel injector 94 is directed to the associated combustion chamber 58.

The fuel injectors 94 preferably spray fuel into the intake ports 70 when the intake valves 72 are opened under control of an engine control unit 96. The sprayed fuel enters the combustion chambers 58 together with the air that passes through the intake passages 66. An amount of the sprayed fuel is determined by the engine control unit 96 in accordance with the amount of the air regulated by the throttle valves 74 to keep a proper air/fuel ratio. Typically, a fuel pressure is strictly managed by the fuel injection system. Thus, the engine control unit 96 determines a duration of the injection to determine the fuel amount, and controls and an injection timing of each injection.

Each engine control unit 96 in this arrangement forms at least a portion of a respective engine control node 98L, 98R of a network 99. Each engine control node 98L, 98R preferably comprises the following: a microcomputer to execute control programs; input and output circuits through which the microcomputer communicates with sensors, the throttle valve actuator, the fuel injectors 94 and the igniters 102; and a bus interface circuit through which the microcomputer communicates with a bus or other communications medium of the network 99. The microcomputer comprises at least a computing processing unit and a storage or memory unit. The storage unit can be built in the computing processing unit. The network 99 will be described shortly. Although the watercraft includes a network 99 in the illustrated embodiment, those skilled in the art will appreciate that the invention may be practiced without the use of a network Other types of fuel supply systems are applicable. For example, a direct fuel injection system that sprays fuel directly into the combustion chambers or a carburetor system can be used.

Each engine 38L, 38R preferably has an ignition or firing system. Each combustion chamber 58 is provided with a spark plug 100. The spark plug 100 is exposed into the associated combustion chamber 58 and ignites an air/fuel charge at a proper ignition timing. The ignition system preferably has ignition coils 101 and igniters 102 which are connected to the engine control unit 96 such that the ignition timing also is under control of the engine control unit 96.

The engine 38L, 38R and the exhaust system build much heat. Thus, each outboard motor 40L, 40R preferably has a cooling system for its engine 38L, 38R and exhaust system. In the illustrated arrangement, the cooling system is an open-loop type water cooling system. Cooling water is introduced into the system from the body of water and is discharged there after traveling around water jackets in the engine 38L, 38R and water passages in the exhaust system. The water jackets preferably are formed in the cylinder block 48 and the cylinder head assembly 54.

As described above, the engine control unit 96 controls at least the throttle valve actuator, the fuel injectors 94 and the igniters 102 in the illustrated embodiment. In order to control those components, the engine control unit 96 monitors to know at least conditions of the engine operation. Each outboard motor 40L, 40R thus has sensors to sense such conditions.

A throttle valve position sensor 103 preferably is provided adjacent to at least one of the throttle valves 74 to sense an actual throttle valve position of the throttle valves 74. A sensed signal is sent to the engine control unit 96.

Associated with the crankshaft 60, a crankshaft angle position sensor 104 preferably is provided to sense a crankshaft angle position and outputs a crankshaft angle position signal to the engine control unit 96. The computing processing unit of the engine control unit 96 (or the engine control nodes 98L, 98R) can calculate an engine speed NL, NR using the crankshaft angle position signals versus time. In this regard, the crankshaft angle position sensor 104 and part of the engine control unit 96 together form an engine speed sensor. The crankshaft angle position sensor 104, or another sensor, can also be used to provide reference position data to the engine control unit 96 for timing purposes, such as for the timing of fuel injection and/or ignition timing.

In one variation, the engine speed sensor can be distinctly formed as an independent device that is coupled with the crankshaft angle position sensor 104 and the engine control unit 96.

An intake air pressure sensor 105 senses an intake pressure at least in one of the intake passages 66. The sensed signal is sent to the engine control unit 96. This signal, as well as the throttle valve position signal, represents an engine load. Additionally or alternatively, an air amount sensor can be disposed at least in one of the intake passages 66 to also sense the engine load.

An engine temperature sensor 106 preferably senses a temperature of the cylinder block 48 and the sensed signal is sent to the engine control unit 96. In one variation, a water temperature sensor placed at one of the water jackets of the cooling system can replace the engine temperature sensor because the water temperature varies generally in accordance with the engine temperature. A cylinder discrimination sensor 107 preferably senses an angle position of the exhaust camshaft and the sensed signal is sent to the engine control unit 96.

Each engine 38L, 38R preferably has an engine starting device 110 which is one part of the engine starting system 32. The engine starting device 110 in this embodiment comprises a starter relay 112, a starter circuit 114 and a starter motor 116. The starter motor 116 preferably has a starter gear that meshes a ring gear affixed onto the crankshaft 60. The starter motor 116 rotates the crankshaft 60 through the gear connection when the starter motor 116 is activated. The starter motor 116 preferably has a one-way clutch that allows the starter motor 116 to drive the crankshaft 60, and to which inhibits the crankshaft 60 from driving the starter motor 116. The starter circuit 114 preferably activates the starter motor when the starter relay 112, which preferably is a normal open relay, is closed. The starter relay 112 preferably is closed when a starter signal, STL or STR, that represents an activation level is provided. The starting device 110 will be described further below in connection with a key switch unit 118 (FIG. 3).

Additionally, each the engine control unit 96 receives a respective stop signal SPL, SPR that, when active (e.g., at ground level), causes operation of the corresponding engine to cease.

With continued reference to FIG. 2, the housing unit 44 journals a driveshaft 122 for rotation. The driveshaft 122 extends generally vertically through the housing unit 44. The crankshaft 60 drives the driveshaft 122. The housing unit 44 also journals a propulsion shaft 124 for rotation. The propulsion shaft 124 extends generally horizontally through a lower portion of the housing unit 44. The driveshaft 122 and the propulsion shaft 124 are preferably oriented normal to each other (e.g., the rotation axis of propulsion shaft 124 is at 90° to the rotation axis of the driveshaft 122). The propulsion shaft 124 drives the propulsion device 36L, 36R. In the illustrated arrangement, the propulsion device 36L, 36R is a propeller 126 that is affixed to an outer end of the propulsion shaft 124. The propulsion device 36L, 36R, however, can take the form of a dual, a counter-rotating system, a hydrodynamic jet, or any of a number of other suitable propulsion devices.

A changeover mechanism 128 preferably is provided between the driveshaft 122 and the propulsion shaft 124. The changeover mechanism 128 in this arrangement comprises a drive pinion 130, a forward bevel gear 132 and a reverse bevel gear 134 to couple the two shafts 122, 124. The drive pinion 130 is disposed at the bottom of the driveshaft 122. The forward and reverse bevel gears 132, 134 are disposed on the propulsion shaft 124 and spaced apart from each other. Both the bevel gears 132, 134 always mesh with the drive pinion 130. The bevel gears 132, 134, however, race on the propulsion shaft 124 unless fixedly coupled with the propulsion shaft 124.

A dog clutch unit (not shown), which also is a member of the changeover mechanism 128, is slidably but not rotatably disposed between the bevel gears 132, 134 on the propulsion shaft 124 so as to selectively engage the forward bevel gear 132 or the reverse bevel gear 134 or not engage any one of the forward and reverse bevel gears 132, 134. The forward bevel gear 132 or the reverse bevel gear 134 can be fixedly coupled with the propulsion shaft 124 when the dog clutch unit engages the forward bevel gear 132 or the reverse bevel gear 134, respectively.

The changeover mechanism 128 further has a shift rod 138 that preferably extends vertically through the steering shaft of the bracket assembly 46. The shift rod 138 can pivot about its own axis. The shift rod 138 has a shift cam 140 at the bottom. The shift cam 140 abuts a front end of the dog clutch unit. The dog clutch unit thus follows the pivotal movement of the cam 140 and slides on the propulsion shaft 124 to engage either the forward or reverse bevel gear 132, 134 or not engage any one of the bevel gears 132, 134.

The propeller 126 rotates in a right direction and propels the watercraft 30 forwardly when the dog clutch unit engages the forward bevel gear 132 (forward mode). The propeller 126 rotates in a reverse direction and propels the watercraft 30 backwardly when the dog clutch unit engages the reverse bevel gear 134. The propeller 126 does not rotate and does not propel the watercraft 37 when the dog clutch unit does not engage the forward or reverse bevel gear 132, 134.

In the illustrated embodiment, a shift rod actuator 142, which preferably is a servo motor, is coupled with the top end of the shift rod 138 to pivot the shift rod 138. The shift rod actuator 142 is under control of a shift control unit 144. The shift control unit 144 in this arrangement forms at least a portion of a shift control node 146L, 146R of the network 99. Each shift control node 146L, 146R has a construction similar to that of the engine control node 98L, 98R. The shift control unit 144 commands the shift rod actuator 142 to actuate the shift rod 138. The shift cam 140 thus brings the dog clutch unit into engagement with the forward or reverse bevel gear 132, 134 or non-engagement with the bevel gears 132, 134.

As described above, the shift control unit 144 controls at least the shift rod actuator 142 in the illustrated embodiment. In order to control the shift rod 130, the shift control unit 144 monitors at least an actual angular position of the shift rod 138. The outboard motor 40L, 40R thus has a shift rod angle position sensor (not shown) adjacent to the shift rod 138. The sensed signal is sent to the shift control unit 144.

With reference to FIGS. 1 and 2, the operator can input a certain throttle valve position command to the engine control unit 96 and a shift position command to the shift control unit 144 preferably through a remote controller 150. The remote controller 150 preferably is disposed at a cockpit of the watercraft 30. The remote controller 150 forms at least a portion of a remote controller node 152 of the network 99. The remote controller node 152 has at least a microcomputer and a bus interface circuit.

The remote controller 150 preferably has a control lever 154 that is journaled on a housing of the remote controller 150 for pivotal movement. The control lever 154 is operable by the operator so as to pivot between two limit ends. A reverse acceleration range, a reverse troll position, a neutral position, a forward troll position and a forward acceleration range can be selected in this order between the limit ends. Preferably, the control lever 154 stays at any position between the limit ends unless the operator operates the lever 154.

A control lever angle position sensor (not shown) is disposed adjacent to the control lever 154 to sense an angle position of the control lever 154. The sensed signal is transferred to the engine control unit 96 and the shift control unit 32 through the network 99.

With reference to FIG. 1, the outboard motor 40L, 40R preferably is steerable relative to the transom 42 of the hull 34. A steering actuator such as, for example, a servomotor is provided at the outboard motor 40L, 40R. The housing unit 44 pivots about a steering axis that extends through the steering shaft of the bracket assembly 46.

A steering unit 158 preferably is placed at a center of the cockpit. The illustrated steering unit 158 incorporates a steering wheel mounted on the hull 34 for pivotal movement and a steering position sensor (not shown) to sense an angle position of the steering wheel. The operator can operate the steering wheel to provide a steering position of the outboard motor 40L, 40R. The steering unit 158 has a steering node 160 of the network 99.

In one variation, each outboard motor 40L, 40R can be mechanically coupled with the steering unit 158 through a mechanical cable. Additionally, the outboard motor 40L, 40R can be tilted about a tilt axis that generally horizontally extends through the tilt pin of the bracket assembly 46.

With continued reference to FIG. 1, a watercraft velocity sensor 164 preferably is mounted on an outer bottom of the hull 34 in the stern of the watercraft 30. The velocity sensor 164 preferably incorporates a Pitot tube and senses a water pressure in the tube to detect a velocity of the watercraft 30. The velocity sensor 164 has a velocity sensor node 164 of the network 99.

The key switch unit 118 preferably is disposed at the cockpit and extends generally between the remote controller 150 and the steering unit 158. The key switch unit 118 acts as an operating device in the illustrated embodiment. Four key switch recesses preferably are formed on a top surface of the key switch unit 118. Each key switch recess can receive a switch key to operate an engine switch assembly 168L for one engine 38L, an auto-start switch 170, an auto-cut switch 172 and an engine switch assembly 168R for the other engine 38R. The key switch recess for those switches 168L, 170, 172, 168R preferably are lined on the top surface of the key switch unit 118 in this order from left to right. The switches 168L, 170, 172, 168R will be described in greater detail below.

Other devices or units can be provided at the cockpit or on the hull 34. For example, a display unit that has a display panel such as a LCD (liquid crystal display) screen can be disposed at the cockpit. The devices and units including the display unit can have their own nodes to take part in the network 99.

With continued reference to FIG. 1, the network 99 in the illustrated embodiment is a controller area network (CAN) that is one type of a local area network (LAN). A bus or bus line 178 of the network 99 interconnects at least the engine control nodes 98L, 98R, the shift control nodes 146L, 146R, the remote controller node 152, the steering node 160, the velocity sensor node 164 and the key switch node 174, which are terminal nodes of the network 99. A network management node 180 also is connected to the bus 178 to manage the terminal nodes 98L, 98R, 146L, 146R, 152, 160, 164, 174.

The illustrated bus 178 preferably is formed with twisted pair cables. Each terminal node 98L, 98R, 146L, 146R, 152, 160, 164, 174 has a classification identifier or ID. Each terminal node 98L, 98R, 146L, 146R, 152, 160, 164, 174 creates a transferring frame or packet that has an ID field in which the classification identifier can be included and a data field in which a product or parts number, a manufacturing number, a manufacturer number and other specific data can be included. Each terminal node 98L, 98R, 146L, 146R, 152, 160, 164, 174 transfers the frame according to certain timing to communicate with one or more other nodes. The management node 180 manages communication among the terminal nodes 98L, 98R, 146L, 146R, 152, 160, 164, 174. The management node 180 assigns a network address to each terminal node 98L, 98R, 146L, 146R, 152, 160, 164, 174. A medium access method such as, for example, a carrier sense multiple access/collision detection (CSMA/CD) method preferably is used to access the bus 178.

The bus 178 can be connected to the nodes 98L, 98R, 146L, 146R, 152, 160, 164, 174, 180 in any form such as, for example, a ring form and a star form. The bus 178 can use any cables or wires other than the twisted pair cables such as, for example, optical cables or ethernet (CAT-5) cables. Furthermore, a wireless type bus that has no cables or wires can replace the illustrated bus 178. A simple communication system that does not need any complicated wiring may be used.

Such an engine control unit, a shift control unit, a remote controller and a network are disclosed in, for example, a co-pending U.S. application Ser. No. 10/624,204, filed Jul. 22, 2003, titled CONTROL CIRCUITS AND METHODS FOR INHIBITING ABRUPT ENGINE MODE TRANSITIONS IN A WATERCRAFT; and a co-pending U.S. application Ser. No. 10/619,095, filed Jul. 11, 2003, titled MULTIPLE NODE NETWORK AND COMMUNICATION METHOD WITHIN THE NETWORK, the entire contents of which are hereby expressly incorporated by reference.

With reference to FIG. 3, the key switch unit 118 with wire harnesses connected to the starting devices 110 and also with the key switch node 174 now is described below.

The key switch unit 118 and the key switch node 174 form another part of the engine starting system 32. The key switch unit 118 in the illustrated embodiment is a switch mechanism. With or without any other components, the switch mechanism is one preferred form of an operating device.

The key switch unit 118 comprises the respective engine switch assemblies 168L, 168R, the auto-start switch 170 and the auto-cut switch 172. The engine switch assemblies 168L, 168R are directly connected to electrical components at least related to the engines 38L, 38R or the engine control unit 96 through a wire harness 166L, 166R. The auto-start switch 170 and the auto-cut switch 172 are connected to the key switch node 174 that is connected to the other terminal nodes through the bus 178 of the network 99.

Each engine switch assembly 168L, 168R preferably is provided to individually supply electric power to, start, and stop the respective engine 38L, 38R. Each engine switch assembly 168L, 168R preferably comprises an electric power switch 184, a start switch 186 and a stop switch 188. The engine switch assembly 168L, 168R is operable by rotating the switch key in the key switch recess and stays at the rotated position unless the switch key is operated. The switches 184, 186, 188 correspond to angle positions within the switch recess. Preferably, the stop switch 188 corresponds to a first or initial position in which the switch key is not rotated. Also, the power switch 184 corresponds to a second position in which the switch key is rotated with a small angle from the initial position. Further, the start switch 186 corresponds to a third position in which the switch key is rotated with a large angle from the initial position. The switches 184, 186, 188 preferably are normally open switches.

In the illustrated arrangement of FIG. 3, one end or an input side end of each power switch 184 is connected to a plus side of one or more batteries BL, BR, while the other end or an output side of the power switch 184 is connected to a main relay that is coupled with the electrical components at least related to each engine 38L, 38R. Electric power PWL, PWR thus is supplied from a battery BL or BR to the main relay when the corresponding power switch 184 is closed.

Also, one end of each start switch 186 is connected to the output side of each power switch 184, while the other end of the start switch 184 is connected to the starter relay 112. The starter signal STL, STR thus is supplied to the starter relay 112 when the corresponding start switch 186 is closed. The starter relay 112 can be held in an activation state as long as the starter signal STL, STR is supplied with the corresponding start switch 186 closed.

Further, one end of each stop switch 188 is connected to the respective engine control unit 96 of the respective engine 38L, 38R, while the other end of the stop switch 188 is grounded. The stop signal SPL, SPR thus is supplied to the corresponding engine control unit 96 when the stop switch 188 is closed. The engine control unit 96 stops its respective engine when the stop signal SPL, SPR is supplied with the corresponding stop switch 188 closed.

The auto-start switch 170 and the auto-cut switch 172 are operable by rotating the switch key in the key switch recess. The switch key, however, returns back to an initial position unless the operator keeps the switch key at the rotated position. That is, auto-start switch 170 and the auto-cut switch 172 are preferably unlocking type and can employ a conventional biasing mechanism. The initial position to which the switch key returns is an open position of the auto-start switch 170 and the auto-cut switch 172. That is, the auto-start switch 170 and the auto-cut switch 172 are normally open switches.

The auto-start switch 170 provides the key switch node 174 with an auto-start signal SS that represents an initiation timing of an auto-start mode. The auto-start signal SS is effective even though the operator releases the auto-start switch 170 after operating the auto-start switch 170 for a moment because only the initiation timing is necessary in the auto-start mode.

The auto-cut switch 172 provides the key switch node 174 with an auto-cut signal SC as long as the operator keeps the auto-cut switch 172 closed. In other words, the auto-cut signal SC ends when the operator releases the auto-cut switch 172.

The engine switches 168L, 168R, the auto-start switch 170 and/or the auto-cut switch 172 can be implemented using switch structures other than key switch structures. For example, at least the auto-start switch 170 and the auto-cut switch 172 can be a push type switches.

With continued reference to FIG. 3, the key switch node 174 preferably comprises the following: a microcomputer to execute control programs; input and output circuits through which the microcomputer communicates with the key switch unit 118 and a bus interface circuit through which the microcomputer communicates with the bus 178. The microcomputer comprises at least a computing processing unit and a storage or memory unit. The storage unit can be integrated with the computing processing unit within a common IC device.

The computing processing unit includes or implements a timer or counter for measuring elapsed time. In the illustrated embodiment, the timer counts a time period after the starter motor 116 is initiated to drive the crankshaft 60 of the respective engine 38L, 38R. The timer also counts a delay time period that will be described below. The timer can be separately provided in one alternative.

The illustrated key switch node 174 preferably is connected to the key switch unit 118 through a wire harness 192. Also, the key switch node 174 can be connected to the batteries BL, BR so as to be supplied with electric power from the batteries BL, BR. Preferably, the key switch node 174 is connected to at least one of the batteries BL, BR when at least one of the power switches 184 of the engine switch assemblies 168L, 168R is closed. In one alternative, the key switch node 174 can have its own power switch that can be separately operated by the operator.

In the illustrated embodiment, the key switch node 174 can hold the starter relay 112 in the activation state even though the start switch 186 is open. Activation relays 192 are provided in the key switch unit 118 to activate the starter relay 112 in place of the start switches 186. Activation relays 192 are normally open relays. One fixed contact 196 of each activation relay 192 is connected to the output side of the power switch 184 of each engine switch assembly 68L, 68R and the other fixed contact 198 of the activation relay 192 is connected the starter relay 112. A relay coil 200 of the activation relay 192 is placed between the output side of the power switch 184 and the key switch node 174. Thus, the relay coil 200 is energized and pulls a free contact of the activation relay 192 to close the activation relay 92. The starter relay 112 is activated accordingly and continues activated as long as the activation relay 192 is in the closed state by the key switch node 192.

Figure 4:
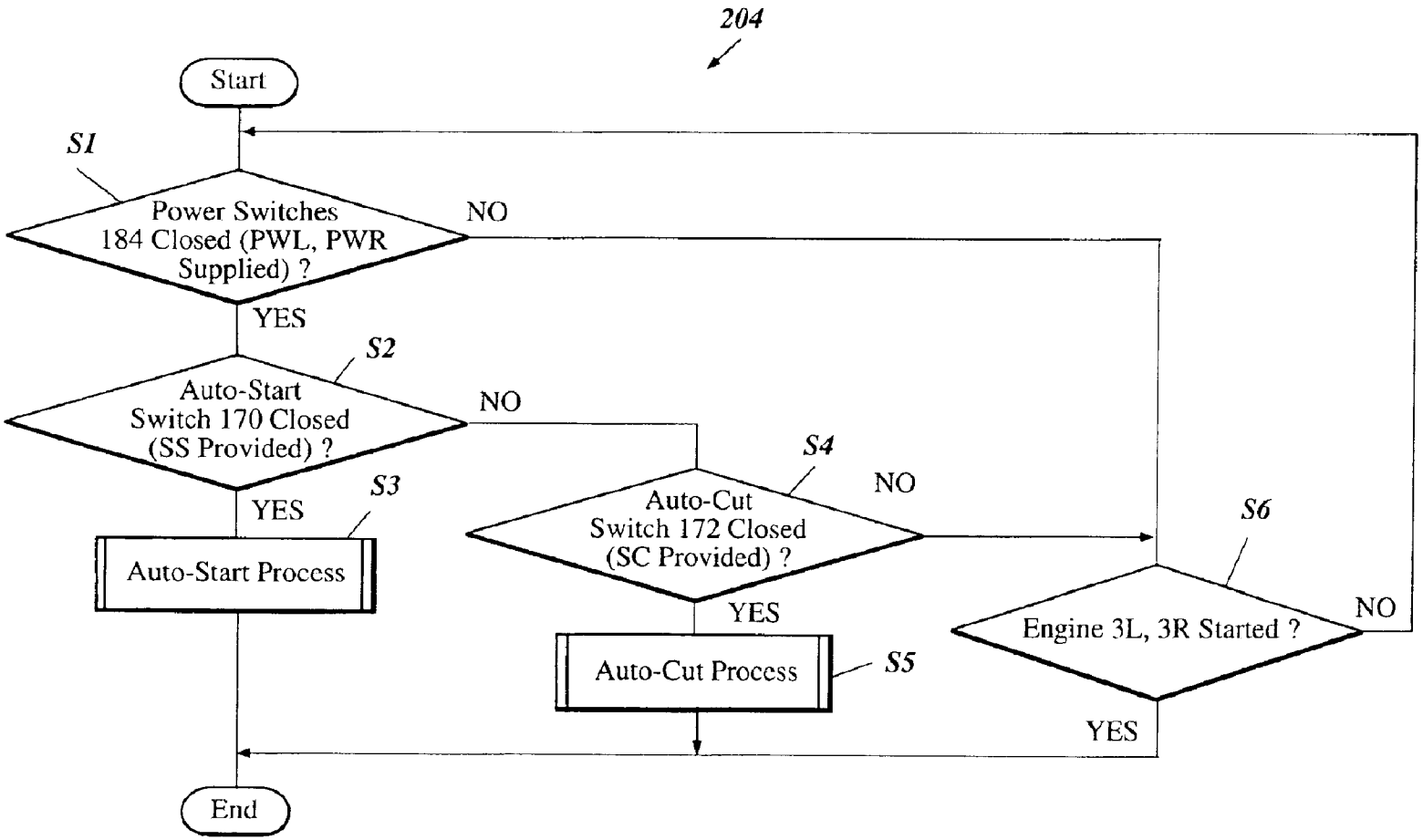
FIG. 4 illustrates a flow chart of an embodiment of a control program that is executed by the key switch node of FIG. 3.

With reference to FIG. 4, the engine starting system 32 preferably provides both of the engines 38L, 38R with a simultaneous engine starting process. The key switch node 174 conducts the engine starting process using a control program 204 in this embodiment.

The control program 204 starts when electric power is supplied to the key switch node 174 and proceeds to a step S1. The key switch node 174, at the step S1, determines whether both of the power switches 184 are closed (i.e., whether the electric power PWL, PWR is supplied to the main relays of the respective engines 38L, 38R). If the determination is positive, the program 204 goes to a step S2.

At the step S2, the key switch node 174 determines whether the auto-start switch 170 is closed to provide the auto-start signal SS. If the determination is positive, the key switch node 174 recognizes that the operator has selected the auto-start mode and the program goes to a step S3. The step S3 is a sub-routine program 206 of FIG. 5 for conducting an auto-start process. The sub-routine program 206 will be described shortly. After the sub-routine program 206 is executed, the program 204 ends.

If the determination at the step S2 is negative, the key switch node 174 determines whether the auto-cut switch 172 is closed to provide the auto-start signal SC. If the determination at the step S4 is positive, the key switch node 174 recognizes that the operator has selected the auto-cut mode and the program goes to a step S4. The step S4 is a sub-routine program 208 of FIG. 6 for conducting an auto-cut process. The sub-routine program 208 will be described shortly. After the sub-routine program 208 is executed, the program 204 ends.

If the determination at the step S4 is negative, the program 204 goes to a step S6 and determines whether one of the engines 38L, 38R is started. In this determination, the key switch node 174 preferably reads an engine speed NL, NR and determines whether either the engine speed NL or the engine speed NR is equal to or greater than a preset engine speed. The preset engine speed preferably is given as an engine speed threshold Nth which represents an engine speed slightly lower than an idle speed Nid. In one variation, the key switch node S6 can use another engine speed at the step S6.

If the determination at the step S6 is negative, the key switch node 174 recognizes that neither engine 38L, 38R is started. The program 204 returns back to and performs step S1. If the determination at the step S6 is positive, the key switch node 174 recognizes that at least one of the engines 38L, 38R is started under an individual start operation by one of the engine switch assemblies 168L, 168R, and the program 204 ends.

Figure 5:
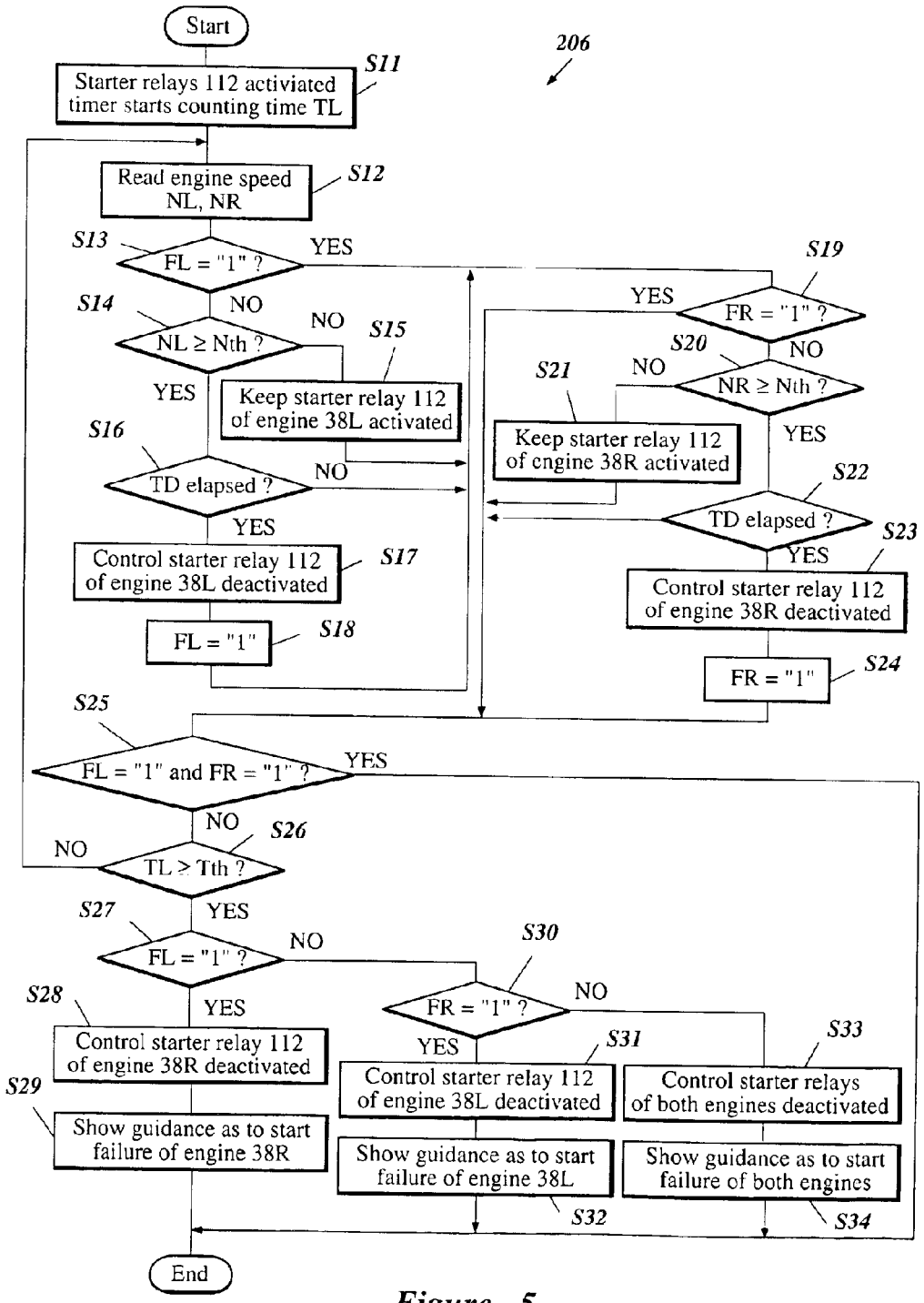
FIG. 5 illustrates a flow chart of an embodiment of a sub-routine program for an auto-start control process conducted as a step of the flow chart of FIG. 4.

With reference to FIG. 5, the sub-routine program 206 for the auto-start process now is described below.

The sub-routine program 206 starts when the determination at the step S2 of the control program 204 is positive and proceeds to a step S11. At the step S11, the key switch node 174 sets the activation relays 192 of the engine switch assemblies 168L, 168R to the closed position that activates the starter relays 112 of both the operating devices 110 for the engines 38L, 38R. That is, the starter signals STL, STR are initiated. Thus, the starter circuit 114 is activated and the starter motor 116 starts driving the crankshaft 62. The key switch node 174 also resets the timer to "0." An activation time period TL thus is initiated. The program 206 then goes to a step S12.

The key switch node 174, at the step S12, reads the engine speeds NL, NR of the engines 38L, 38R. The program 206 goes to a step S13.

At the step S13, the key switch node 174 determines whether a start completion flag FL is set to "1." The level "1" of the flag FL indicates that the engine 38L is in a start completion state. If the determination is positive, the program 206 goes to a step S19 that will be described shortly. If determination at the step S13 is negative, the program 206 goes to a step S14.

The key switch node 174, at the step S14, determines whether the engine speed NL of the engine 38L is equal to or greater than the engine speed Nth that represents the engine speed slightly lower than the idle speed Nid as described above. If the determination at the step S14 is negative, the key switch node 174 recognizes that the engine 38L has not been started and the program 206 goes to a step S15. The key switch node 174 keeps the activation relay 192 of the engine switch 168L closed. Then, the program 206 goes to the step S19.

If the determination at the step S14 is positive, the key switch node 174 recognizes that the engine 38L has been started and the program 206 goes to a step S16.

At the step S16, the key switch node 174 determines whether a preset delay time period TD has elapsed after the moment that the engine speed NL becomes equal to the engine speed threshold Nth. The delay time TD preferably is counted by the timer. In one variation, another timer can count the delay time TD.

If the determination at the step S16 is negative, the program 206 goes to the step S19. If the determination at the step S16 is positive, the program 206 goes to a step S17. The key switch node 174, at the step S17, deactivates (opens) the activation relay 192 of the engine 38L. Also, the key switch node 174 creates a transferring frame that has engine start completion data in the data field and transfers the frame to the engine control node 98L through the bus 178. Then, the program 206 goes to a step S18. At the step S18, the key switch node 174 sets the start completion flag FL to "1."

At the step S19, the key switch node 174 determines whether a start completion flag FR is set to "1." The level "1" of the flag FR indicates that the engine 38R is in a start completion state. If the determination is positive, the program 206 goes to a step S25 that will be described shortly. The determination at the step S19 is negative, the program 206 goes to a step S20.

The key switch node 174, at the step S20, determines whether the engine speed NR of the engine 38R is equal to or greater than the engine speed Nth. If the determination at the step S20 is negative, the key switch node 174 recognizes that the engine 38R has not been started and the program 206 goes to a step S21. The key switch node 174 keeps the activation relay 192 of the engine switch assembly 168R closed. Then, the program 206 goes to the step S25.

If the determination at the step S20 is positive, the key switch node 174 recognizes that the engine 38R has been started and the program 206 goes to a step S22. At the step S22, the key switch node 174 determines whether the preset delay time period TD has elapsed after the moment that the engine speed NR becomes equal to the engine speed threshold Nth.

If the determination at the step S22 is negative, the program 206 goes to the step S25. If the determination at the step S22 is positive, the program 206 goes to a step S23. The key switch node 174, at the step S23, deactivates (opens) the activation relay 192 of the engine 38R. Also, the key switch node 174 creates a transferring frame that has engine start completion data in the data field and transfers the frame to the engine control node 98R through the bus 178. Then, the program 206 goes to a step S24. At the step S24, the key switch node 174 sets the start completion flag FR to the level of "1." The program 206 goes to the step S25.

At the step S25, the key switch node 174 determines whether both of the start completion flags FL FR are set to "1." If the determination at the step S25 is positive, the key switch node 174 recognizes that both of the engines 38L, 38R have been started. The sub-routine program 206 ends and the control program 204 of FIG. 4 also ends.

If the determination at the step S25 is negative, the key switch node 174 recognizes at least one of the engines 38L, 38R has not started and the program 206 goes to a step S26. The key switch node 174, at the step S26, determines whether the activation time period TL is equal to or greater than a preset activation time threshold Tth. The activation time threshold Tth is equal to the maximum time or an activation allowable time period in which the key switch node 74 is allowed to keep the activation relay 192 closed.

If the determination at the step S26 is negative, the key switch node 174 recognizes that the activation allowable time period has not elapsed and the program 206 returns back to the step S12 and the key switch node 174 conducts the step S12.

If the determination at the step S26 is positive, the program 206 goes to a step S27. At the step S27, the key switch node 174 determines whether the start completion flag FL is set to "1." If the determination at the step S27 is positive, the key switch node 74 recognizes that the engine 38R has not been started and that the engine 38L has been started. The program 206 goes to a step S28, and deactivates (opens) the activation relay 192 of the engine 38R. The program 206 then goes to a step S29.

The key switch node 174, at the step S29, creates a transferring frame that has engine start failure data regarding the engine 38R in the data field and transfers the frame to the bus 178. Preferably, the display unit shows some guidance information including the engine start failure data of the engine 38R on the display panel and/or makes the buzzer sound. The sub-routine program 206 and the control program 204 of FIG. 4 then end.

If the determination at the step S27 is negative, the program 206 goes to a step S30, and determines whether the start completion flag FR is set to "1." If the determination at the step S30 is positive, the key switch node 74 recognizes that the engine 38L has not been started, and that the engine 38R has been started. The program 206 then goes to a step S31 and deactivates (opens) the activation relay 192 of the engine 38L. The program 206 then goes to a step S32.

The key switch node 174, at the step S32, creates a transferring frame that has engine start failure data regarding the engine 38L in the data field and transfers the frame to the bus 178. Preferably, the display unit shows some guidance information including the engine start failure data of the engine 38L on the display panel and/or makes the buzzer sound. The sub-routine program 206 and the control program 204 of FIG. 4 then end.

If the determination at the step S30 is negative, the key switch node 74 recognizes that both of the engines 38L, 38R have not been started. The program 206 goes to a step S33, and opens both of the activation relays 192. The program 206 then goes to a step S34.

The key switch node 174, at the step S34, creates a transferring frame that has engine start failure data regarding both of the engines 38L, 38R in the data field and transfers the frame to the bus 178. Preferably, the display unit shows some guidance information including the engine start failure data of the engines 38L, 38R on the display panel and/or makes the buzzer sound. The sub-routine program 206 and the control program 204 of FIG. 4 then end.

Figure 6:
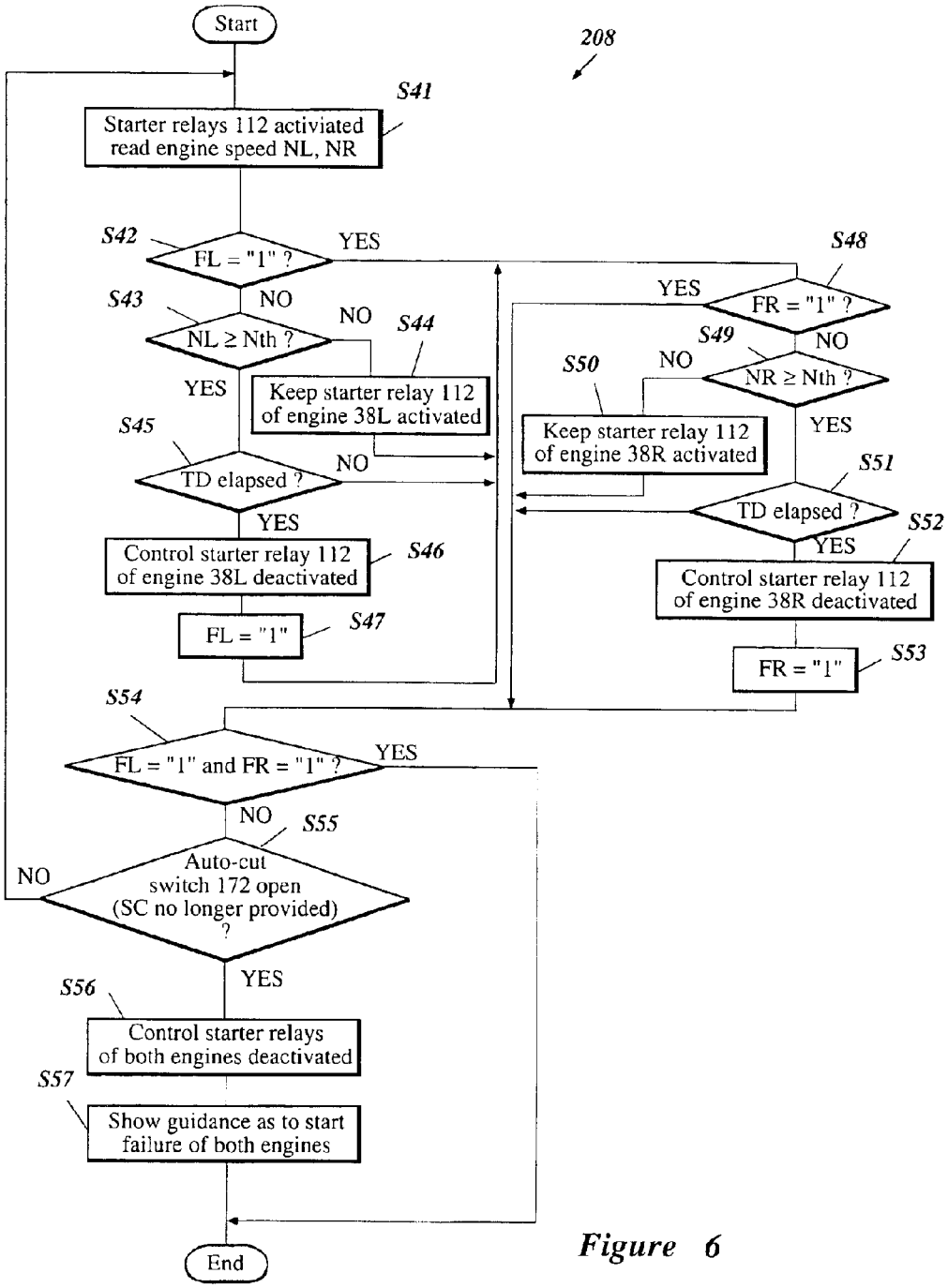
FIG. 6 illustrates a flow chart of an embodiment of a sub-routine program for an auto-cut control process conducted as another step of the flow chart of FIG. 4.

With reference to FIG. 6, the sub-routine program 208 for the auto-cut process now is described below.

The sub-routine program 208 starts when the determination at the step S4 of the control program 204 is positive and proceeds to a step S41. The key switch node 174, at the step S41, activates (closes) the activation relays 192 of the engine switch assemblies 168L, 168R. That is, the starter signals STL, STR are initiated. Thus, within each engine, the starter circuit 114 is activated and the starter motor 116 starts driving the crankshaft 62. The key switch node 174, at the step S41, also reads the engine speed NL, NR of the engines 38L, 38R. The program 208 then goes to a step S42.

At the step S42, the key switch node 174 determines whether a start completion flag FL is set to "1." If the determination is positive, the program 208 goes to a step S48 that will be described shortly. The determination at the step S42 is negative, the program 208 goes to a step S43.

The key switch node 174, at the step S43, determines whether the engine speed NL of the engine 38L is equal to or greater than the engine speed Nth. If the determination at the step S43 is negative, the key switch node 174 recognizes that the engine 38L has not been started and the program 208 goes to a step S44. The key switch node 174 keeps the activation relay 192 of the engine switch 168L closed in this event. Then, the program 208 goes to the step S48.

If the determination at the step S43 is positive, the key switch node 174 recognizes that the engine 38L has been started and the program 208 goes to a step S45.

At the step S45, the key switch node 174 determines whether the preset delay time period TD has elapsed since the engine speed NL reached the engine speed threshold Nth.

If the determination at the step S45 is negative, the program 208 goes to the step S48. If the determination at the step S45 is positive, the program 208 goes to a step S46. The key switch node 174, at the step S46, deactivates or opens the activation relay 192 of the engine 38L. Also, the key switch node 174 creates a transferring frame that has engine start completion data in the data field and transfers the frame to the engine control node 98L through the bus 178. Then, the program 208 goes to a step S47 and sets the start completion flag FL to "1." The program 208 then goes to the step S48.

At the step S48, the key switch node 174 determines whether the start completion flag FR is set to "1." If the determination is positive, the program 208 goes to a step S54 that will be described shortly. The determination at the step S48 is negative, the program 208 goes to a step S49.

The key switch node 174, at the step S49, determines whether the engine speed NR of the engine 38R is equal to or greater than the engine speed Nth. If the determination at the step S49 is negative, the key switch node 174 recognizes that the engine 38R has not been started and the program 208 goes to a step S50. The key switch node 174 keeps the activation relay 192 of the engine switch assembly 168R closed. Then, the program 208 goes to the step S54.

If the determination at the step S49 is positive, the key switch node 174 recognizes that the engine 38R has been started and the program 208 goes to a step S51. At the step S51, the key switch node 174 determines whether the preset delay time period TD has elapsed since the engine speed NR reached to the engine speed threshold Nth.

If the determination at the step S51 is negative, the program 208 goes to the step S54. If the determination at the step S51 is positive, the program 208 goes to a step S52. The key switch node 174, at the step S52, opens or deactivates the activation relay 192 of the engine 38R. Also, the key switch node 174 creates a transferring frame that has engine start completion data in the data field and transfers the frame to the engine control node 98R through the bus 178. Then, the program 208 goes to a step S53. At the step S53, the key switch node 174 sets the start completion flag FR to "1." The program 208 then goes to the step S54.

At the step S54, the key switch node 174 determines whether the start completion flags FL and FR are both set to "1." If the determination at the step S54 is positive, the key switch node 174 recognizes that both of the engines 38L, 38R have been started. The sub-routine program 208 ends and the control program 204 of FIG. 4 also ends.

If the determination at the step S54 is negative, the key switch node 174 recognizes at least one of the engines 38L, 38R has not started and the program 208 goes to a step S55. The key switch node 174, at the step S55, determines whether the auto-cut switch 172 is open and the auto-cut signal SC is not provided.

If the determination at the step S55 is positive, meaning that the auto-cut switch 172 closed, the program 208 returns back to the step S41 and the key switch node 174 conducts the step S41.

If the determination at the step S55 is negative, meaning that both of the engines 38L, 38R have not been started, the program 208 goes to a step S56 and deactivates (opens) both of the activation relays 192. The program 208 then goes to a step S57.

The key switch node 174, at the step S57, creates a transferring frame that has engine start failure data regarding both of the engines 38L, 38R in the data field and transfers the frame to the bus 178. Preferably, the display unit shows some guidance information including the engine start failure data of the engines 38L, 38R on the display panel and/or makes the buzzer sound. The sub-routine program 208 and the control program 204 of FIG. 4 then end.

Figure 7:
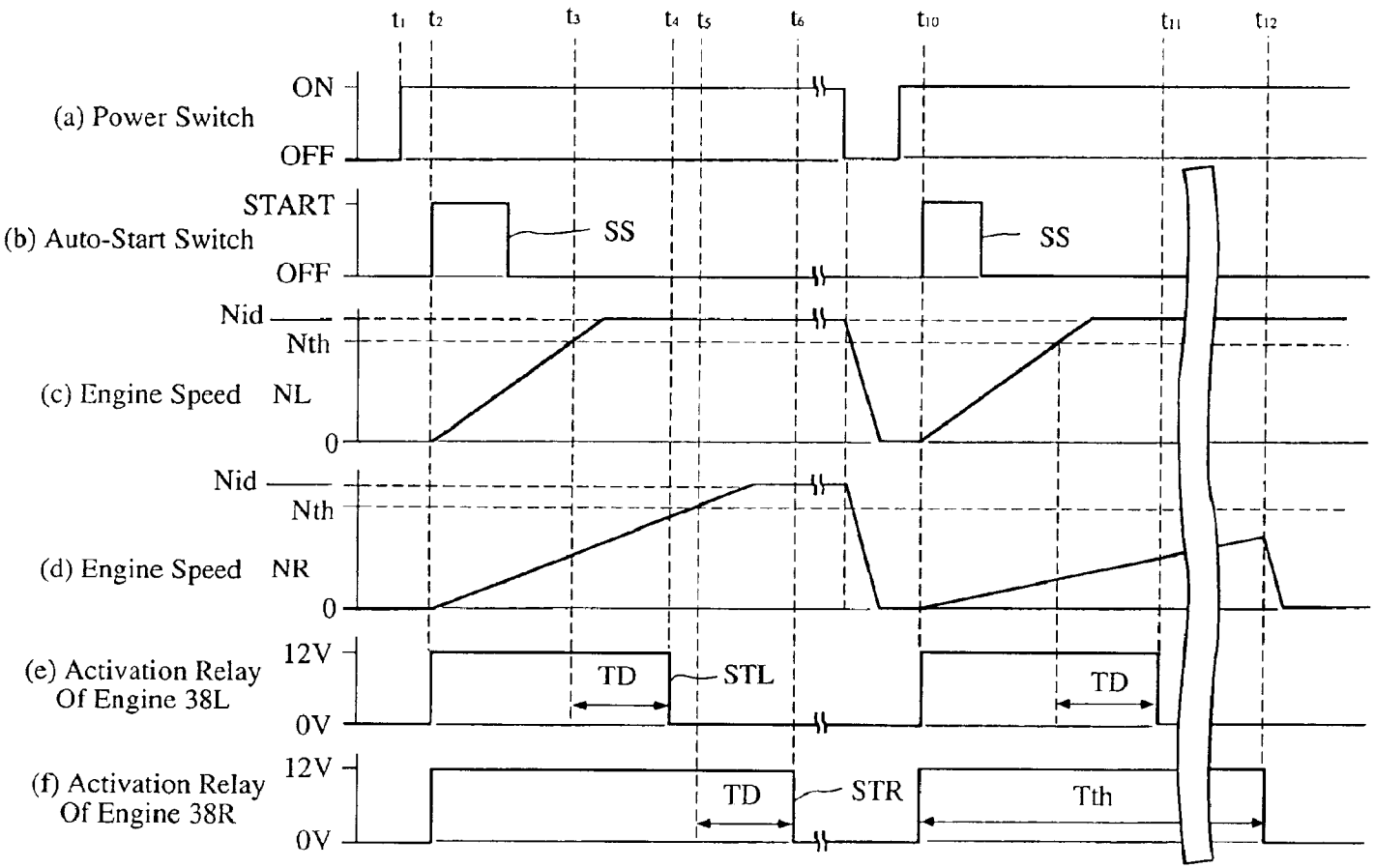
FIG. 7 illustrates a time chart of exemplary transitions of an auto-start mode that is achieved by the sub-routine program of FIG. 5 for the auto-start control process, wherein part (a) shows a transition of the electric power, part (b) shows a transition of an auto-start signal, part (c) shows a transition of an engine speed of one of the engines, part (d) shows a transition of an engine speed of the other engine, part (e) shows a transition of a starter signal for the engine that has the engine speed of part (c), and part (f) shows a transition of a starter signal for the engine that has the engine speed of part (d)

With reference to FIGS. 4, 5 and 7, an exemplary auto-start mode is described below.

Initially, the power switches 184 of the engine switch assemblies 168L, 168R are open. Thus, the respective main relays connected to the power switches 184 are not supplied with electric power PWL, PWR as shown in the part (a) of FIG. 7 (OFF state). The entire electrical components including the engine control unit 96, the shift control unit 144, the terminal nodes 98L, 98R, 146L, 146R, 152, 160, 174 and the management node 180 are not activated. The engines 38L, 38R do not operate.

At the time t1, the operator simultaneously or separately closes the power switches 184. In the illustrated embodiment, the operator inserts the main switch key into the switch key recesses and rotates the switch key to the second position. The power PWL, PWR thus is supplied to the entire set of electrical components at the time t1 as shown in the part (a) of FIG. 7 (ON state). The management node 180 assigns network addresses to the respective terminal nodes 98L, 98R, 146L, 146R, 152, 160, 174 and then the nodes 98L, 98R, 146L, 146R, 152, 160, 174 are able to communicate with each other.

The determination at the step S1 of the program 204 of FIG. 4 becomes positive at time t1. However, all the determinations at the steps S2, S4, S6 are negative. The program 204 thus repeats the steps S1, S2, S4 and S6.

The operator closes the auto-start switch 170 at the time t2. The auto-start signal SS thus is provided to the key switch node 174. The auto-start signal SS continues as long as the operator keeps the auto-start switch 170 closed in this embodiment, although the rise of the auto-start signal SS is the most important in the auto-start mode because it triggers the auto-start process. The determination at the step S2 becomes positive at the time t2. The auto-start mode that is conducted by the sub-routine 206 of FIG. 5 thus is initiated.

The key switch node 174 closes the activation relays 192 (step S1) at the time t2. In other words, the initiation timing is provided to each activation relay 192 at the time t2. Accordingly, the starter signals SPL, SPR are initiated and supplied to the starter relays 112 as shown in the parts (e) and (f) of FIG. 7. The starter motors 116 of the respective engines 38L, 38R thus are activated through the starter circuits 114. The engine speed NL of the engine 38L and the engine speed of the engine 38R starts increasing at the time t2 as shown in the part (c) and the part (d) of FIG. 7, respectively. In this example, the increase rate of the engine speed NL is greater than the increase rate of the engine speed NR. The key switch node 174 reads the engine speeds NL, NR at the step S12. The engine control unit 96 starts controlling the injection timings and durations of the fuel injections by the fuel injectors 94 and the ignition timing of the igniters 102. Also, the timer starts counting the time period TL at the time t2.

The key switch node 174 keeps the activation relays 192 closed for awhile even though the operator releases the auto-start key 170. More specifically, the program 206 of FIG. 5 proceeds over S13–S15, S19–S21, S25 and S26 and returns back to the step S12 because all the determinations at the steps S13, S14, S19, S20, S25 and S26 are negative. This is because the engine start completion flags FL, FR are at the level "0", both the engine speeds NL, NR are lower than the engine speed threshold Nth, and the time period TL is less than the activation time threshold Tth. The starter motors 116 thus continue driving the crankshaft 60.

The engine speed NL of the engine 38L becomes equal to the engine speed threshold Nth at the time t3 as shown in the part (c) of FIG. 7. The determination at the step S14 becomes positive, indicating that the engine 38L was very likely started. The determination at the step S16, however, is still negative until the delay time TD elapses. The activation relay 192 for the engine 38L continues supplying the starter signal STL during the delay time TD to keep the starter motor 116 driving the crankshaft 60. This increases the likelihood that the engine will remain running after the starter motor is disengaged.

During the delay time TD, the engine speed NL can reach the idle speed Nid as shown in the part (c) of FIG. 7. The engine control unit 96 of the engine 38L controls the engine 38L to maintain the engine speed at the idle speed Nid unless the operator controls the remote control lever 154. Meanwhile, the program 206 jumps to the step S19 and the key switch node 174 conducts the step S19 and the following steps S20, S21, S25 and S26 so as to continue the start process of the engine 38R.

The delay time TD for engine 38L elapses at time t4 as shown in the part (e) of FIG. 7. The determination at the step S16 of the program 206 of FIG. 5 now becomes positive. The key switch node 174 thus controls the activation relay 194 for the engine 38L to open at the step S17. The activation signal STL is no longer supplied to the starter relay 112. Thus, the starter motor 116 of the engine 38L stops driving the crankshaft 60. Now that the start of the engine 38L is completed, the key switch node 174 creates the transferring frame that has the engine start data of the engine 38L in the data field and transfers the frame to the engine control node 98L through the bus 178 also at the step S17. Then, the key switch node 174 sets the start completion flag FL of the engine 38L to "1" at the step S18.

Afterwards, the program 206 of FIG. 7 immediately jumps to the step S19 and the key switch node 174 concentrates on starting the engine 38R. The engine speed NR of the engine 38R becomes equal to the engine speed threshold Nth at the time t5 as shown in the part (d) of FIG. 7. The determination at the step S20 becomes positive, indicating that the engine 38R was very likely started. The determination at the step S22, however, is still negative until the delay time TD elapses. The activation relay 192 for the engine 38R continues supplying the starter signal STR during the delay time TD to keep the starter motor 116 driving the crankshaft 60.

During the delay time TD, the engine speed NR can reach the idle speed Nid as shown in the part (d) of FIG. 7. The engine control unit 96 of the engine 38R controls the engine 38R to maintain the engine speed at the idle speed Nid unless the operator controls the remote control lever 154.

The delay time TD for engine 38R elapses at the time t6 as shown in the part (f) of FIG. 7. The determination at the step S22 of the program 206 of FIG. 5 now becomes positive. The key switch node 174 thus controls the activation relay 194 for the engine 38R to open at the step S23. The activation signal STR is no longer supplied to the starter relay 112. Thus, the starter motor 116 of the engine 38R stops driving the crankshaft 60. Now that the start of the engine 38R is completed, the key switch node 174 creates the transferring frame that has the engine start data of the engine 38R in the data field and transfers the frame to the engine control node 98R through the bus 178 also at the step S23. Then, the key switch node 174 sets the start completion flag FR of the engine 38R to "1" at the step S24.

On the other hand, in another example that is also shown in FIG. 7 (beginning at t10), both of the engines 38L, 38R enter the start process at time t10. The engine 38L is started first, and the delay time TD for the engine 38L elapses at the time t11 during the activation allowable time period TL (i.e., the activation time threshold Tth) that elapses at the time t12. However, the engine 38R is not started during the activation allowable time period TL because the slow rate of increase of the engine speed NR of the engine 38R causes the activation allowable time period TL to expire before the engine speed NR reaches the engine speed threshold Nth, as shown in the parts (d) and (f) of FIG. 7.

At time t12, the determination at the step S25 is negative because the start completion flag FR is "0." In addition, the determination at the step S26 is positive because the time TL has elapsed and the determination at the step S27 is positive because the engine 38L has been started. The key switch node 174 thus conducts the step S28. That is, the key switch node 174 opens or deactivates the activation relay 194 for the engine 38R, causing the starter motor 116 of the engine 38R to stop so that battery power is conserved. The key switch node 174 also creates a transferring frame that has engine start failure data of the engine 38R in the data field and transfers the frame to the engine control node 98R through the bus 178 at the step S28. The key switch node 174 then controls the display node at the step S29 to show on the LCD screen that the engine 38R has failed to start and/or to sound the buzzer. The operator is thus notified that the engine 38R did not properly start.

As thus described, in the illustrated auto-start operation, the engines 38L, 38R can be automatically and rapidly started with the operator's activation of the auto-start switch 170. Also, if either or both of the engines 38L, 38R do not start within a preset or preprogrammed time TL, the start process is advantageously stopped to save electric power.

Figure 8:
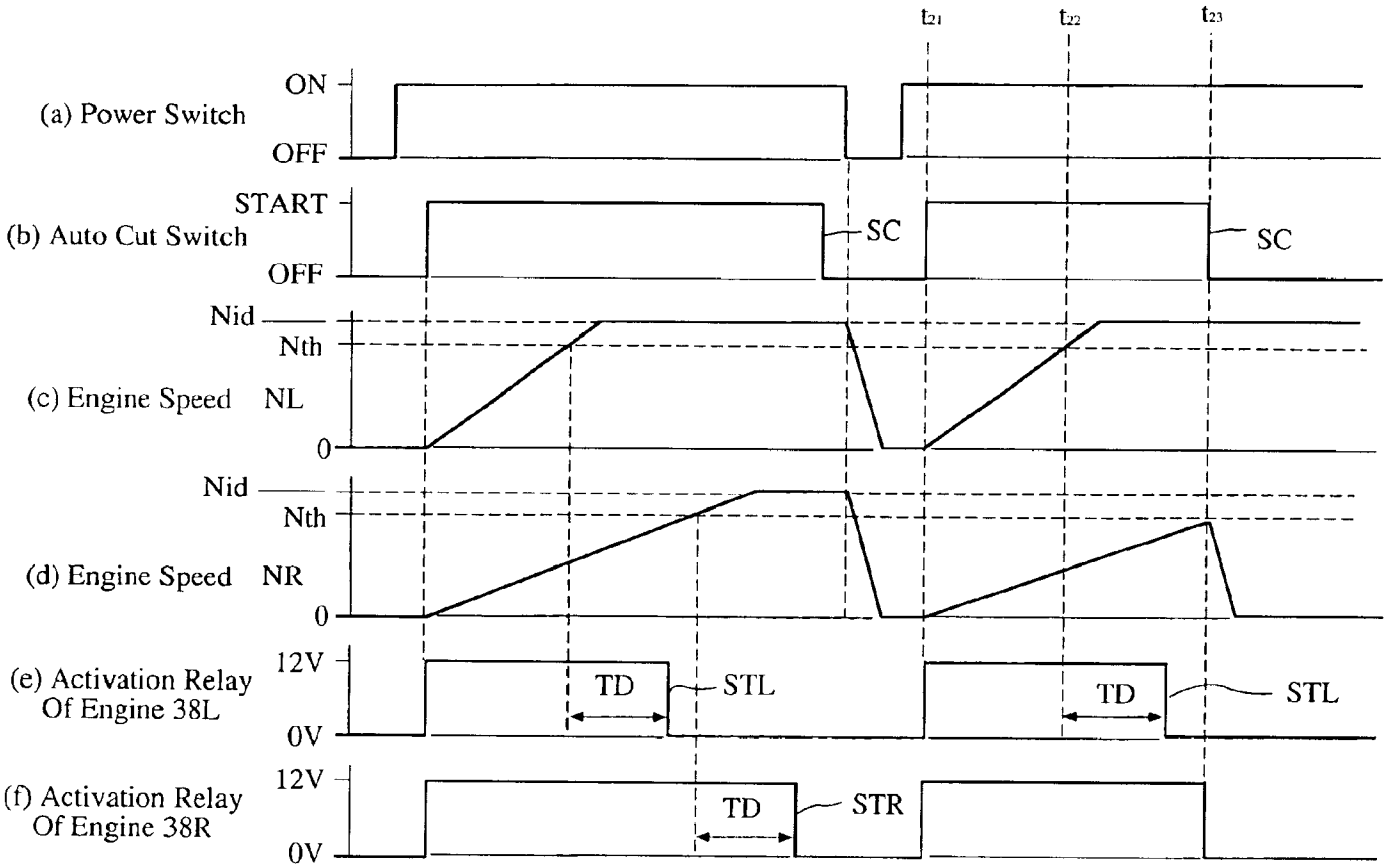
FIG. 8 illustrates a time chart of exemplary transitions of an auto-cut mode that is achieved by the sub-routine program of FIG. 6 for the auto-cut control process, wherein part (a) shows a transition of the electric power, part (b) shows a transition of the auto-start signal, part (c) shows a transition of the engine speed of one of the engines, part (d) shows a transition of the engine speed of the other engine, part (e) shows a transition of the starter signal for the engine that has the engine speed of part (c), and part (f) shows a transition of the starter signal for the engine that has the engine speed of part (d)

With reference to FIGS. 4, 6 and 8, an exemplary auto-cut mode is described below.

The determination at the step S4 of the program 204 of FIG. 4 is positive if the operator closes the auto-cut switch 172. The auto-cut signal SC thus is provided to the key switch node 174. The auto-cut signal SC continues as long as the operator keeps the auto-cut switch 172 closed as shown in the part (b) of FIG. 8. Similarly to the auto-start process described above, each starter motor 116 stops after the delay time TD elapses if the engine speed NL, NR reaches the engine speed threshold Nth while the auto-cut switch 172 is closed as shown in parts (b), (c), (d), (e) and (f) of FIG. 8. Both of the engines 38L, 38R are started under this condition.

On the other hand, in another example that is also shown in FIG. 8, both engines 38L, 38R enter the start process at time t21. The engine speed NL of the engine 38L reaches the engine speed threshold Nth at time T22 as shown in the part (c) of FIG. 8. The delay time TD for the engine 38L elapses while the auto-cut signal SS continues. The engine 38L thus is normally started.

The operator opens the auto-cut switch 172 at time t23. The auto-cut signal SC is no longer supplied to the activation relay 194 for the engine 38R afterwards as shown in the part (b) of FIG. 8. At time t23, the determination at the step S55 of the program 208 of FIG. 6 thus is positive. The starter relay 112 is deactivated to stop the starter motor 116 of the engine 38R at the step S56. The key switch node 174 also creates a transferring frame that has the start failure data of the engine 38R in the data field and transfers the frame to the engine control node 98R through the bus 178 at the step S56. The key switch node S29 then controls the display node at the step S57 to show on the LCD that the engine 38R has failed to start and/or to sound the buzzer.

As thus described, in the illustrated auto-cut operation, the engines 38L, 38R can be automatically and sequentially started while the operator operates the auto-cut switch 172. The engine start can be rapidly achieved, accordingly. Also, if either or both of the engines 38L, 38R cannot be started within the activation allowable time period TL, the start process is advantageously stopped to save electric power. In addition, the operator can determine the activation allowable time period at his or her will by determining a time period to keep the auto-cut switch 72 closed.

Under the condition that either or both of the engines 38L, 38R are not started in the auto-start mode or the auto-cut mode, the operator can use either the engine switch assembly 168L, 168R or both engine switch assemblies 168L, 168R to start either or both of the engines 38L, 38R. The start operation using the engine switch assembly 168L, 168R generally takes more time. However, this start operation can provide the operator with the ability to start each engine individually.

In the preferred embodiment described above, the key switch node 174 works as a control device with the key switch unit 118 working as an operating device. Each engine control node 98L, 98R at least in part acts as a sensing device, or mediates the control device and the engine speed sensor, if the engine speed sensor is separately provided. The construction is advantageous because an additional control device is not necessary and the network can be quite simple. Other units or nodes in the network 99 can work as the control device. Also, another unit or node can be added as the control device to the network 99.

Figure 9:
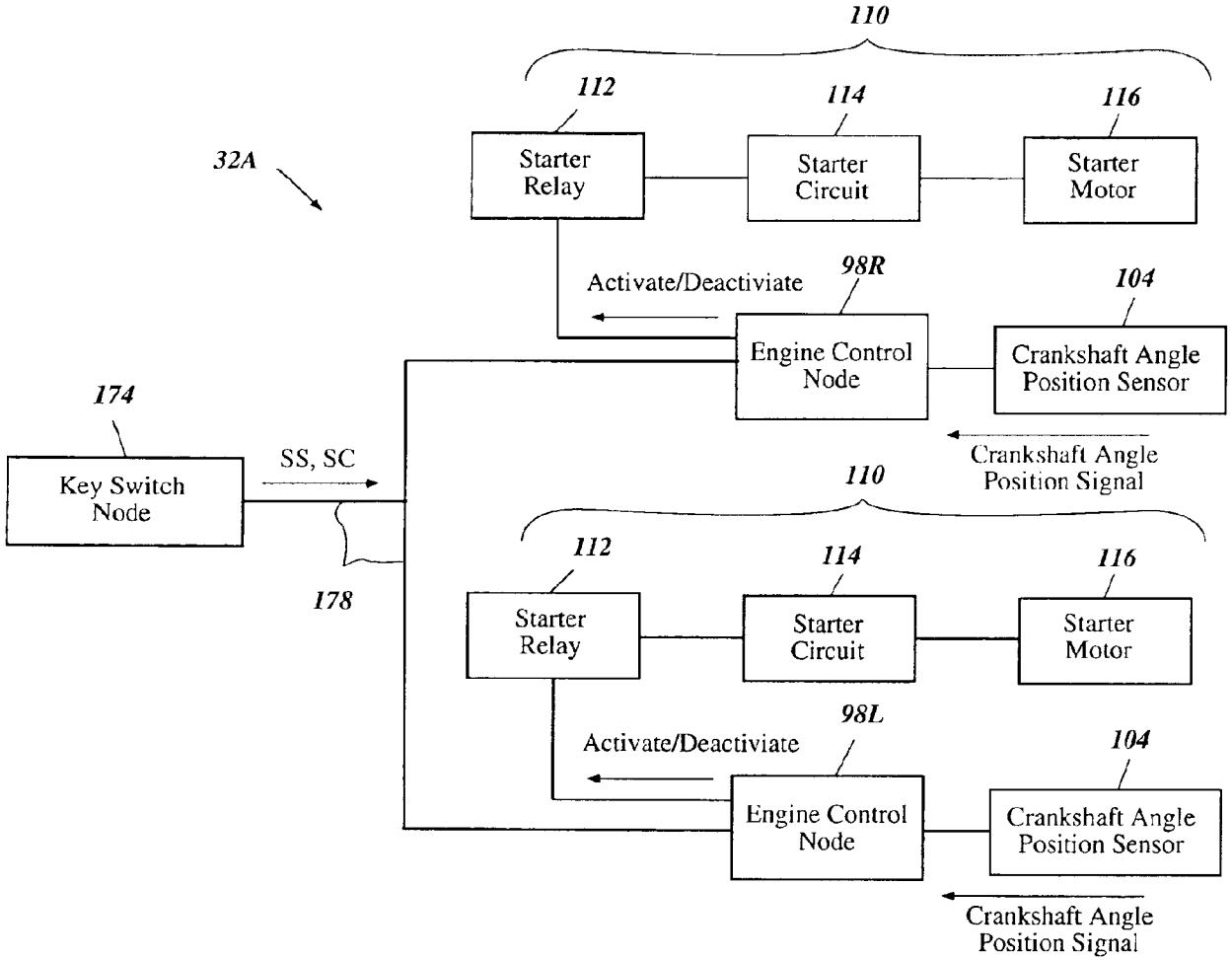
FIG. 9 illustrates a modified engine starting system configured in accordance with a second preferred embodiment.

With reference to FIG. 9, a modified engine starting system 32A configured in accordance with a second embodiment is described below. The engine control nodes 98L, 98R work as the control device in this modified engine starting system 32A. The same devices, components and signals that have been already described above are assigned with the same reference numerals or reference marks and are not described repeatedly.

In the modified system 32A, each engine control node 98L, 98R connected to the key switch node 174 through the bus 178 acts as the control device for each engine 38L, 38R. Each starting device 110, which comprises the starter relay 112, the starter circuit 114 and the starter motor 116, preferably is connected to each engine control node 98L, 98R through a wire harness or other equivalent connecting measures. Also, each crankshaft angle position sensor 104 preferably is connected to each engine control node 98L, 98R through a wire or other equivalent connecting measures. Each engine control node 98L, 98R together with the crankshaft angle position sensor 104 can act as a sensing device that senses the engine speed NL, NR also in this embodiment, although the sensing device can be separately formed.

The key switch node 174 in this embodiment acts as a node to provide the engine control nodes 98L, 98R with the auto-start signal SS and the auto-cut signal SC. That is, the key switch node 174 in this embodiment is part of the operating device, or mediates the engine control nodes 98L, 98R and the key switch unit 118. The key switch node 174 preferably creates a transferring frame that has a network address and a type of the signal of its own in the ID field and the state of the auto-start signal SS or the state of the auto-cut signal SC in the data field whenever the state of the auto-start signal SS or the state of the auto-cut signal SC changes (e.g., the state of the auto-start signal SS changes at a moment when the auto-start switch 170 is closed while the auto-start switch 170 was open at an immediately previous moment), and transfers the frame to the bus 178.

The engine control unit 96 of each engine control node 98L, 98R preferably receives the transferring frame and reads the auto-start signal SS or the auto-cut signal SC. Each engine control node 98L, 98R preferably executes the control program 174 of FIG. 4 and the sub-routine programs 206 of FIG. 5 and 208 of FIG. 6 except for the steps belonging to the other engine control node 98L, 98R. That is, in connection with the engine control node 98L, the steps belonging to the other engine control node 98R are the steps S19–S24 of the program 206 of FIG. 5 and the steps S48–S53 of the program 208 of FIG. 6. Also, in connection with the engine control node 98R, the steps belonging to the other engine control node 98L are the steps S13–S18 of the program 206 of FIG. 5 and the steps S42–S47 of the program 208 of FIG. 6.

Figure 10:
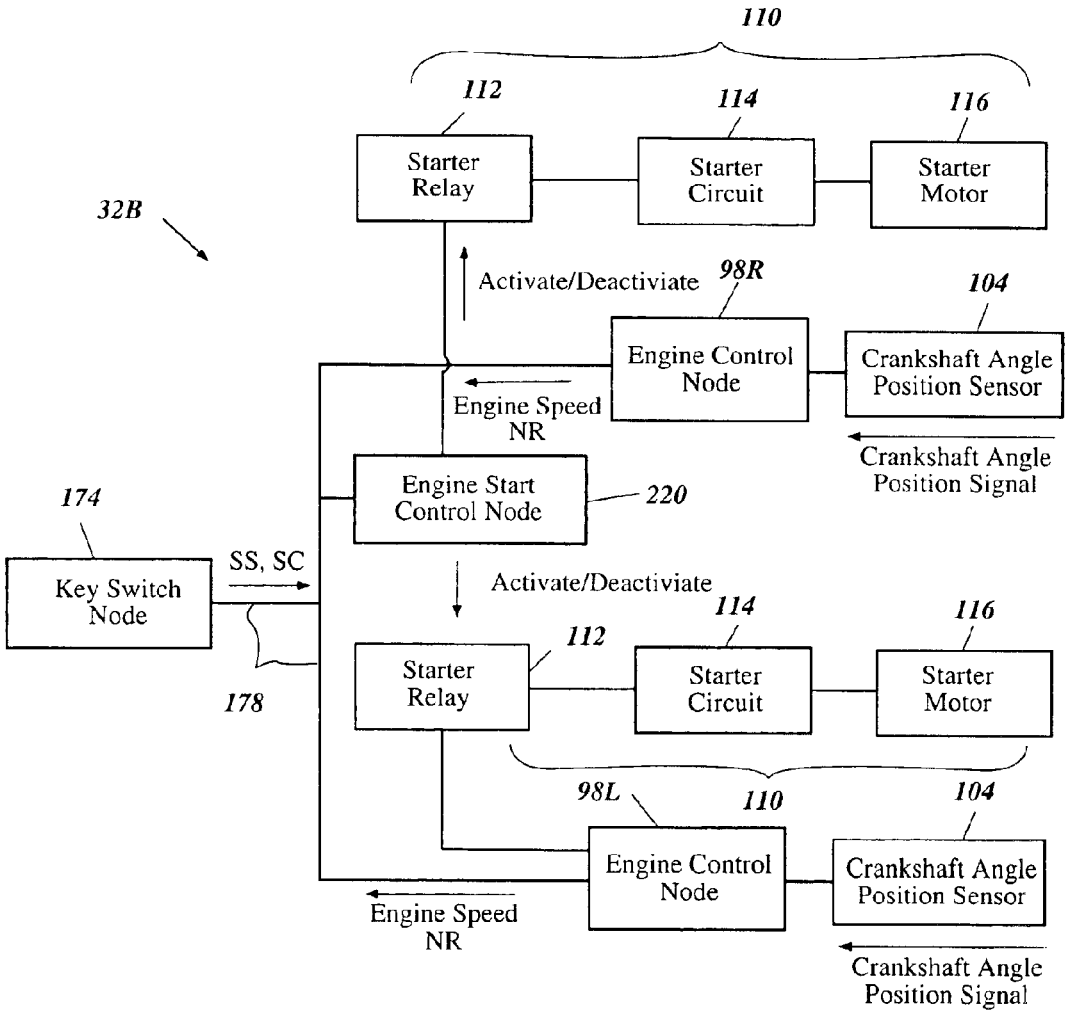
FIG. 10 illustrates another modified engine starting system configured in accordance with a third preferred embodiment.

With reference to FIG. 10, another modified engine starting system 32B configured in accordance with a third embodiment is described below. A special control node that works as the control device is added in this modified engine starting system 32A. Again, the same devices, components and signals that have been already described above are assigned with the same reference numerals or reference marks and are not described repeatedly.

In the modified system 32B, an engine start control node 220 that acts as the control device for both of the engines 38L, 38R is connected to the key switch node 174 and the engine control node 98L, 98R through the bus 178. The key switch node 174 preferably creates a transferring frame that has the auto-start signal SS or the state of the auto-cut signal SC in the data field whenever the state of the auto-start signal SS or the state of the auto-cut signal SC changes and transfers the frame to the bus 178. Also, each engine control node 98L, 98R creates a transferring frame that has the engine speed NL, NR in the data field and transfers the frame to the bus 178. The engine start control node 220 receives the frame from the key switch node 174 and also receives the frame from each engine control node 98L, 98R. The engine start control node 220 executes both the control program 174 of FIG. 4 and the sub-routine programs 206 of FIG. 5 and 208 of FIG. 6 in this embodiment.

The key switch unit 118 can have various structures. For example, a common power switch can replace the individual engine switches 168L, 168R. The common power switch preferably controls the power supply to all electrical components not only belong to the engines 38L, 38R but also to the watercraft 30.

The engine start control processes described above can also be applied to engines that are not four-cycle engines. For example, the control processes can be applied to two-cycle engines or rotary engines.

The network using LAN (including CAN) is useful to realize the rapid, smooth and precise communications. However, the terminal nodes can alternatively communicate using a different type of network such as a wireless LAN, or can communicate via direct connections between nodes without the use of a network. For example, electric wire harnesses can be used.

Terminal nodes other than the engine control nodes and the key switch node can have a similar construction to those of the engine control nodes and the key switch node. For example, these nodes can incorporate a microcomputer to execute various programs.

Although this invention has been disclosed in the context of a certain preferred embodiment and examples, it will be understood by those skilled in the art that the present invention extends beyond the specifically disclosed embodiment to other alternative embodiments and/or uses of the invention and obvious modifications and equivalents thereof. In addition, while several variations of the invention have been shown and described, other modifications, which are within the scope of this invention, will be readily apparent to those of skill in the art based upon this disclosure. It is also contemplated that various combination or sub-combinations of the specific features and aspects of the embodiments or variations may be made and still fall within the scope of the invention. It should be understood that various features and aspects of the disclosed embodiment can be combined with or substituted for one another in order to form varying modes of the disclosed invention. Thus, it is intended that the scope of the present invention herein disclosed should not be limited by the particular disclosed embodiments described above, but should be determined only by a fair reading of the claims that follow.

What is claimed is:

1. A watercraft comprising a plurality of engines, a plurality of starting devices, each starting device coupled with a respective engine to power the associated engine for starting, a control device that controls the starting devices, a common operating device that provides the control device with at least an initiation signal to activate the starting devices, and a sensing device that separately senses an individual start completion state of each engine, the control device activating each starting device when the operating device provides the initiation signal and deactivating each starting device in response to the sensing device sensing the individual start completion state of the respective engine.

2. The watercraft as set forth in claim 1, wherein the operating device comprises a switch mechanism that is operable by an operator, the switch mechanism providing the control device with the initiation in response to operator activating the switch mechanism, the control device deactivating each starting device in response to the sensing device sensing the individual start completion state of the respective engine during a preset time period or deactivating the starting devices when the preset time period elapses.

3. The watercraft as set forth in claim 2, wherein the control device delays deactivating the each starting device for a second preset time period when the sensing device senses the individual start completion state of the each engine.

4. The watercraft as set forth in claim 1, wherein the operating device comprises a switch mechanism that is operable by an operator, the switch mechanism provides the control device with the initiation signal when the operator start operating the switch mechanism, the control device deactivates the each starting device when the sensing device senses the individual start completion state of the each engine during a time period such that the operator continues operating the switch mechanism or deactivates the starting devices when the operator stops operating the switch mechanism.

5. The watercraft as set forth in claim 4, wherein the control device delays deactivating each starting device for the time period when the sensing device senses the individual start completion state of the corresponding engine.

6. The watercraft as set forth in claim 1 additionally comprising a network, the sensing device creating data based upon a signal indicative of the individual start completion state of each engine and transferring the data to the control device on the network, the control device controlling the starting devices based upon the data.

7. The watercraft as set forth in claim 1 additionally comprising a network, the operating device creating data including at least the initiation signal to activate the starting devices and transferring the data to the control device over the network, the control device activating each starting device based upon the data.

8. The watercraft as set forth in claim 7 comprising a plurality of the control devices, each control device controlling a respective starting device.

9. The watercraft as set forth in claim 1 additionally comprising a network, the operating device creating first data including at least the initiation signal to activate the starting devices and transferring first data to the control device through the network, the sensing device creating second data based upon a signal indicative of the individual start completion state of each engine and transferring the second data to the control device over the network, the control device activating each starting device based upon the first data and controlling the starting devices based upon the second data.

10. The watercraft as set forth in claim 1 additionally comprising a network that has at least first and second nodes, the first node acting as the control device, the second node at least in part acting as the sensing device or mediating between the control device and the sensing device.

11. The watercraft as set forth in claim 1 additionally comprising a network that has at least first and second nodes, the first node acting as the control device, the second node at least in part acting as the operating device or mediating between the control device and the operating device.

12. The watercraft as set forth in claim 1 additionally comprising a network that has at least first, second and third nodes, the first node acting as the control device, the second node at least in part acting as the sensing device or mediating between the control device and the sensing device, and the third node at least in part acting as the operating device or mediating between the control device and the operating device.

13. The watercraft as set forth in claim 1, wherein each starting device includes a starter motor coupled with a crankshaft of a respective engine.

14. The watercraft as set forth in claim 1, wherein the sensing device senses the individual start completion state of an engine at least in part by determining whether an engine speed is equal to or greater than a preset engine speed.

15. The watercraft as set forth in claim 1 comprising a plurality of outboard motors detachably mounted on a hull of the watercraft, each outboard motor incorporating a respective engine.

16. A watercraft comprising a plurality of engines, a plurality of starting devices, each starting device coupled with a respective engine to power the associated engine for starting, a control device that controls the starting devices, a common operating device that provides the control device with an activation allowable time period or an initiation timing to initiate the activation allowable time period, and a sensing device that separately senses an individual start completion state of each engine, the control device activating the starting devices during the activation allowable time period, the control device deactivating each starting device separately and in response to the sensing device sensing the individual start completion state of the respective engine.

17. The watercraft as set forth in claim 16, wherein the control device comprises a timer to count the activation allowable time period when the operating device provides the control device with the initiation timing to initiate the activation allowable time period.

18. The watercraft as set forth in claim 16, wherein the control device delays deactivating each starting device for a preset time period when the sensing device senses the individual start completion state the respective engine.

19. The watercraft as set forth in claim 16, wherein the operating device comprises a switch mechanism that is operable by an operator, the switch mechanism providing the control device with the activation allowable time period or the initiation timing to initiate the activation allowable time period.

20. An engine starting system for multiple engines, each engine having a starting device to power the engine for starting, the system comprising a control device that controls the starting devices, a common operating device that provides the control device with at least an initiation signal to concurrently activate the starting devices, and a sensing device that separately senses an individual start completion state of each engine, the control device activating each starting device when the operating device provides the initiation signal and deactivating each starting devices in response to the sensing device sensing the individual start completion state of the corresponding engine.

21. The engine starting system as set forth in claim 20, wherein the operating device comprises a switch mechanism that is operable by an operator, the switch mechanism providing the control device with the initiation signal when the operator starts operating the switch mechanism, the control device deactivating each starting device if either the sensing device senses the individual start completion state of the respective engine or the preset time period elapses.

22. The engine starting system as set forth in claim 20, wherein the operating device comprises a switch mechanism that is operable by an operator, the switch mechanism providing the control device with the initiation signal when the operator activates the switch mechanism, the control device deactivating each starting device if the sensing device senses the individual start completion state of the respective engine during a time period such that the operator continues operating the switch mechanism or deactivates the starting devices when the operator stops operating the switch mechanism.

23. The engine starting system as set forth in claim 20, wherein the sensing device senses the individual start completion state of each engine at least in part by monitoring an engine speed of each engine.

24. An engine starting method for multiple engines of a vehicle, each engine having a starting device to power the engine for starting, the method comprising generating an activation initiating signal, concurrently activating the starting devices based upon the activation initiating signal to start the engines, separately sensing an individual start completion state of each engine, and deactivating each starting device separately in response to detection of an individual start completion state of the corresponding engine.

25. The engine starting method as set forth in claim 24 additionally comprising operating a switch mechanism to generate the activation initiating signal, counting a preset time period after the activation initiating signal is generated, and deactivating each starting device separately from one another if either the individual start completion state of the respective engine is sensed or the preset time period expires.

26. A system for concurrently starting a plurality of engines of a watercraft, wherein each engine includes a respective starter motor, the system comprising: a sensor circuit that senses a start state of each of the engines; an auto-start switch that can be actuated by an operator to initiate an auto-start process; and a control circuit that is responsive to operator actuation of the auto-start switch by concurrently activating the respective starter motors of each of a plurality of engines; wherein the control circuit deactivates each starter motor in response to detection by the sensor circuit that the respective engine has started, such that the starter motors are deactivated asynchronously to one another during said auto-start process.

27. The system of claim 26, wherein the sensor circuit senses the start states of the engines at least in-part by monitoring an engine speed of each engine.

28. The system of claim 26, wherein the control circuit is responsive to detection by the sensor circuit that an engine has started by waiting for a preprogrammed delay period before deactivating the corresponding starter motor, said preprogrammed delay period selected to increase a probability that the engines with remain in a started state following starter motor deactivation.

29. The system of claim 26, wherein the control circuit further deactivates the respective starter motor of each engine that does not start within an allowable auto-start time period.

30. The system of claim 29, further comprising an additional switch that allows the operator to manually control said allowable auto-start time period.

31. A method of starting a plurality of engines of a watercraft, the method comprising controlling a plurality of starting devices with a controlling device, each starting device being coupled with a respective engine to power the associated engine for starting, providing at least an initiation signal from a common operating device, concurrently activating each starting device when the operating device provides the initiation signal, sensing an individual start completion state of each engine with a sensing device, and deactivating each starting device in response to the sensing device sensing the individual start completion state of the respective engine.

* * * * *